US006546210B1

(12) United States Patent
Nakamura

(10) Patent No.: US 6,546,210 B1
(45) Date of Patent: Apr. 8, 2003

(54) CUT SHEET PACKAGING MEMBER AND IMAGE FORMING APPARATUS

(75) Inventor: Kazuo Nakamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 111 days.

(21) Appl. No.: 09/709,478

(22) Filed: Nov. 13, 2000

(30) Foreign Application Priority Data

Nov. 11, 1999 (JP) ..... 11-321729
Nov. 11, 1999 (JP) ..... 11-321730

(51) Int. Cl.[7] ..... G03G 15/00; B65H 1/00

(52) U.S. Cl. ..... 399/12; 206/449; 206/459.5; 229/235; 271/145; 355/72; 399/389; 400/582

(58) Field of Search ..... 399/12, 45, 84, 399/389, 393; 355/72; 271/145; 400/578, 582; 229/234, 235; 206/459.5, 449

(56) References Cited

U.S. PATENT DOCUMENTS

| | | | | |
|---|---|---|---|---|
| 3,367,487 A | | 2/1968 | Dwyer | |
| 5,053,814 A | | 10/1991 | Takano et al. | 355/208 |
| 5,067,835 A | | 11/1991 | Yamamoto et al. | 400/582 |
| 5,137,269 A | * | 8/1992 | Yamamoto | 271/145 |
| 5,459,580 A | | 10/1995 | Suzuki | 358/296 |
| 5,765,091 A | | 6/1998 | Kovach et al. | 399/393 |

FOREIGN PATENT DOCUMENTS

| | | | | |
|---|---|---|---|---|
| JP | 1-11860 A | * | 1/1989 | |
| JP | 2-116577 | | 5/1990 | B41J/15/00 |
| JP | 6-202422 A | * | 7/1994 | |
| JP | 6-226963 | | 8/1994 | B41J/2/01 |
| JP | 11-91958 | | 4/1999 | B65H/1/26 |
| JP | 11-216909 | | 8/1999 | B41J/2/44 |
| WO | 99/02348 | | 1/1999 | B41J/13/10 |

OTHER PUBLICATIONS

European Search Report.
Abstract JP6226963 Aug. 16, 1994.
Abstract JP2116577 May 1, 1990.
Patent Abstract of Japan JP11091958 Apr. 6, 1999.
Patent Abstract of Japan JP11216909 Dec. 16, 1998.

* cited by examiner

*Primary Examiner*—Joan Pendegrass
(74) *Attorney, Agent, or Firm*—Sughrue Mion, PLLC

(57) ABSTRACT

On a cut sheet packaging member 50, a separation line 53 for dividing the cut sheet packaging member into a lid part 51 and a body part 52 is formed. Cut sheet information 57 expressed by a bar code is affixed to the body part 52 at a position close to the separation line 53. In the inside of a sheet feed opening 42 of a printer 30, a bar code reader 46 is disposed. By inserting the body part 52 together with the cut sheets into the sheet feed opening 42, the cut sheet information 57 affixed to the body part 52 is read by the bar code reader 46.

24 Claims, 22 Drawing Sheets

CUT SHEET PACKAGING MEMBER AND IMAGE FORMING APPARATUS

BACKGROUND OF THE INVENTION

1. Field of the Invention

The present invention relates to an image forming apparatus such as a printer or a copying machine, a storage medium for storing an operation program of an image forming control apparatus which controls the image forming apparatus, a packaging member for cut sheets used for the image forming apparatus, and a cut sheet packaging body having a plurality of cut sheets and a packaging member to wrap these cut sheets.

2. Description of the Related Art

Conventionally, in printing cut sheets, a user first takes out the cut sheets wrapped by a packaging paper and sets these cut sheets in a feeder portion of a printer after leveling the cut sheets once. Subsequently, cut sheet information such as a kind of cut sheets and the like on cut sheets used for printing are inputted to a printer host so as to make the printer perform the printing.

However, in such a prior art, the user has to input such cut sheet information by himself or herself, so that there arises a problem that the operation becomes extremely cumbersome. Further, if the cut sheet information such as the kind of sheets is erroneously inputted, there arises other problems including a problem that the printing quality becomes deteriorated.

Further, the prior art also suffers from a problem that the setting of the cut sheets or the like at the time of exchanging the cut sheets becomes cumbersome.

SUMMARY OF THE INVENTION

Accordingly, it is a first object of the present invention to provide a storage medium which stores an operation program of an image forming control apparatus so as to allow a user to omit the inputting operation of cut sheet information by himself or herself.

It is a second object of the present invention to provide a cut sheet packaging member which can faciliate setting of cut sheets or the like at the time of exchanging cut sheets used for an image forming apparatus.

The first cut sheet packaging member for achieving the above-mentioned first object is a cut sheet packaging member which accommodates a stack of cut sheets used for image forming in an image forming apparatus, wherein a separation line for dividing the cut sheet packaging member into a lid part and a body part is formed and cut sheet information readable by a sensor is affixed to the body part at a position close to the separation line.

The second cut sheet packaging member for achieving the above-mentioned first object is a cut sheet packaging member which accommodates a stack of cut sheets used for forming images in an image forming apparatus, wherein a separation line for dividing the cut sheet packaging member into a lid part and a body part is formed, a portion to be latched which is engaged with a portion of a sheet feeding part of the image forming apparatus so as to prevent the body part from being fed to the image forming apparatus together with the cut sheets is formed on the body part, and cut sheet information readable by a sensor is affixed to the body part.

The third cut sheet packaging member for achieving the above-mentioned first object is a cut sheet packaging member which accommodates a plurality of rectangular cut sheets used for forming images in an image forming apparatus in a stacked state, wherein a first separation line for dividing the cut sheet packaging member is formed such that a portion of the cut sheet packaging member corresponding to one longitudinal end side of the rectangular cut sheets accommodated therein constitutes a body part and a portion of the cut sheet packaging member corresponding to the other longitudinal end side of the rectangular cut sheets accommodated therein constitutes a lid part, and second separation line for dividing the cut sheet packaging member is formed such that a portion of the cut sheet packaging member corresponding to one lateral end side of the rectangular cut sheets accommodated therein constitutes a body part and a portion of the cut sheet packaging member corresponding to the other lateral end side of the rectangular cut sheets accommodated therein constitutes a lid part, and cut sheet informations readable by a sensor are respectively affixed to the body part when divided by the first separation line and the body part when divided by the second separation line.

The fourth cut sheet packaging member for achieving the above-mentioned first object is a cut sheet packaging member which accommodates a stack of rectangular cut sheets used for forming images in an image forming apparatus, wherein a first separation line for dividing the cut sheet packaging member is formed such that a portion of the cut sheet packaging member corresponding to one longitudinal end side of the rectangular cut sheets accommodated therein constitutes a body part and a portion of the cut sheet packaging member corresponding to the other longitudinal end side of the rectangular cut sheets accommodated therein constitutes a lid part, and a second separation line for dividing the cut sheet packaging member is formed such that a portion of the cut sheet packaging member corresponding to one lateral end side of the rectangular cut sheets accommodated therein constitutes a body part and a portion of the cut sheet packaging member corresponding to the other lateral end side of the rectangular cut sheets accommodated therein constitutes a lid part, portions to be latched which are engaged with a portion of the image forming apparatus are respectively formed on a portion of the body part when divided by the first separation line and on a portion of the body part when divided by the second separation line such that the body part is not fed to the image forming apparatus together with the cut sheets, and cut sheet informations readable by a sensor are respectively affixed to the body part when divided by the first separation line and the body part when divided by the second separation line.

In any one of the above-mentioned first to fourth cut sheet packaging members, the fifth cut sheet packaging member for achieving the above-mentioned first object is characterized in that when the lid part is removed and a side which has been covered with the lid part is directed toward the image forming apparatus and a plurality of cut sheets which are covered by the body part are disposed in the image forming apparatus, among a fixed guide and a movable guide which guide the widthwise position of the cut sheets in the image forming apparatus, the cut sheet information is affixed to the body part disposed at a position which constitutes the fixed guide side.

In the fifth cut sheet packaging member, the sixth cut sheet packaging member for achieving the above-mentioned first object is characterized in that among a plurality of faces which constitute the body part, the cut sheet information is affixed to one surface which faces one-side faces of a plurality of packaged cut sheets in an opposed manner, and when the lid part is removed and a side which has been covered with the lid part is directed toward the image forming apparatus and a plurality of cut sheets which are covered by the body part are disposed in the image forming apparatus, a face of the body part which faces the fixed guide in an opposed manner is removably formed.

In any one of the above-mentioned first to fourth cut sheet packaging members, the seventh cut sheet packaging member for achieving the above-mentioned first object is characterized in that within the face which faces the cut sheets in an opposed manner, the cut sheet information is affixed to the center position of the body part in a direction perpendicular to the cut sheet insertion direction directed from the body part to the lid part.

In any one of the above-mentioned first to seventh cut sheet packaging members, the eighth cut sheet packaging member for achieving the above-mentioned first object is characterized in that the cut sheet informations are affixed in parallel to the cut sheet insertion direction directed from the body part to the lid part.

In any one of the above-mentioned first to eighth cut sheet packaging members, the ninth cut sheet packaging member for achieving the above-mentioned first object is characterized in that an arrow showing the cut sheet insertion direction directed from the body part to the lid part is affixed to the body part.

In a cut sheet packaging member which accommodates a plurality of cut sheets on which an image is formed by an image forming apparatus, the tenth cut sheet packaging member for achieving the above-mentioned first object is characterized in that the cut sheet packaging member includes an information card portion to which cut sheet information readable by the sensor is provided and the information card portion is removably mounted.

In any one of the above-mentioned first to tenth cut sheet packaging members, the eleventh cut sheet packaging member for achieving the above-mentioned first object is characterized in that the cut sheet information includes at least one of model number, size, kind of sheet, thickness, number of sheets, unit price and the like of the cut sheets.

In any one of the above-mentioned first to eleventh cut sheet packaging members, the twelfth cut sheet packaging member for achieving the above-mentioned first object is characterized in that the cut sheet information is indicated by a bar code.

In any one of the above-mentioned first to twelfth cut sheet packaging members, the thirteenth cut sheet packaging member for achieving the above-mentioned first object is characterized in that the cut sheet information is indicated by characters as well as by a bar code.

The first cut sheet packaging member for achieving the above-mentioned second object is a cut sheet packaging member which accommodates a stack of cut sheets used for forming images in an image forming apparatus, wherein a separation line for dividing the cut sheet packaging member into a lid part and a body part is formed and a portion to be latched which is engaged with a portion of a sheet feeding part of the image forming apparatus so as to prevent the body part from being fed to the image forming apparatus together with the cut sheets is formed on the body part.

The second cut sheet packaging member for achieving the above-mentioned second object is a cut sheet packaging member which accommodates a stack of rectangular cut sheets used for forming images in an image forming apparatus, wherein a first separation line for dividing the cut sheet packaging member is formed such that a portion of the cut sheet packaging member corresponding to one longitudinal end side of the rectangular cut sheets accommodated therein constitutes a body part and a portion of the cut sheet packaging member corresponding to the other longitudinal end side of the rectangular cut sheets accommodated therein constitutes a lid part, and a second separation line for dividing the cut sheet packaging member is formed such that a portion of the cut sheet packaging member corresponding to one lateral end side of the rectangular cut sheets accommodated therein constitutes a body part and a portion of the cut sheet packaging member corresponding to the other lateral end side of the rectangular cut sheets accommodated therein constitutes a lid part, portions to be latched which are engaged with a portion of the image forming apparatus are respectively formed on a portion of the body part when divided by the first separation line and on a portion of the body part when divided by the second separation line such that the body part is not fed to the image forming apparatus together with the cut sheets.

The first cut sheet packaging body for achieving the above-mentioned first object is characterized in that the first cut sheet packaging body includes the cut sheet packaging member of any one of the first to twelfth cut sheet packaging members and a plurality of cut sheets accommodated therein.

The second cut sheet packaging body for achieving the above-mentioned first object is a cut sheet packaging body which includes a plurality of cut sheets used for image forming by an image forming apparatus and a cut sheet packaging member which accommodates a plurality of such cut sheets, wherein the cut sheet packaging member is provided with a separation line for dividing the cut sheet packaging member into a lid part and body part and among a plurality of cut sheets stacked in the inside of the cut sheet packaging member, the cut sheet disposed at an end of the stacking direction has with cut sheet information readable by a sensor affixed.

The third cut sheet packaging body for achieving the above-mentioned first object is a cut sheet packaging body which includes a plurality of rectangular cut sheets on which an image is formed by an image forming apparatus and a cut sheet packaging member which accommodates a plurality of such cut sheets, wherein a first separation line for dividing the cut sheet packaging member is formed such that a portion of the cut sheet packaging member corresponding to one longitudinal end side of the rectangular cut sheets accommodated therein constitutes a body part and a portion of the cut sheet packaging member corresponding to the other longitudinal end side of the rectangular cut sheets accommodated therein constitutes a lid part, and a second separation line for dividing the cut sheet packaging member is formed such that a portion of the cut sheet packaging member corresponding to one lateral end side of the rectangular cut sheets accommodated therein constitutes a body part and a portion of the cut sheet packaging member corresponding to the other lateral end side of the rectangular cut sheets accommodated therein constitutes a lid part, and among a plurality of cut sheets stacked in the inside of the cut sheet packaging member, cut sheet information readable by a sensor is affixed to the cut sheet positioned at an end in the stacking direction.

In the second or the third cut sheet packaging body, the fourth cut sheet packaging body for achieving the above-mentioned first object is characterized in that the cut sheet information is affixed to a portion which is disposed on the cut sheet positioned at the end of the stacking direction and is exposed when the lid body is separated from the body part.

In any one of the above-mentioned second to fourth cut sheet packaging bodies, the fifth cut sheet packaging body for achieving the above-mentioned first object is characterized in that when the lid part is removed and a side which has been covered with the lid part is directed toward the image forming apparatus and a plurality of cut sheets which are covered by the body part are disposed at the sheet feeding portion in the image forming apparatus, among a fixed guide and a movable guide which guide the widthwise position of the cut sheets in the image forming apparatus, the cut sheet information is affixed at a position which constitutes the fixed guide side.

In any one of the above-mentioned second to fifth cut sheet packaging bodies, the sixth cut sheet packaging body for achieving the above-mentioned first object is characterized in that the cut sheet information is affixed to the center position of the cut sheet in a direction perpendicular to the cut sheet insertion direction directed from the body part to the lid part.

In any one of the above-mentioned second to sixth cut sheet packaging bodies, the seventh cut sheet packaging body for achieving the above-mentioned first object is characterized in that the cut sheet information is, among a plurality of cut sheets stacked in the inside of the cut sheet packaging member, affixed to the cut sheet positioned at both ends of the stacking direction.

In any one of the above-mentioned second to seventh cut sheet packaging bodies, the eighth cut sheet packaging body for achieving the above-mentioned first object is characterized in that the cut sheet informations are affixed in parallel to the cut sheet insertion direction directed from the body part to the lid part.

In any one of the above-mentioned second to eighth cut sheet packaging bodies, the ninth cut sheet packaging body for achieving the above-mentioned first object is characterized in that an arrow showing the cut sheet insertion direction directed from the body part to the lid part is affixed to the body part.

In any one of the above-mentioned second to ninth cut sheet packaging bodies, the tenth cut sheet packaging body for achieving the above-mentioned first object is characterized in that the cut sheet information includes at least one of model number, size, kind of sheet, thickness, number of sheets, unit price and the like.

In any one of the above-mentioned second to tenth cut sheet packaging members, the eleventh cut sheet packaging body for achieving the above-mentioned first object is characterized in that the cut sheet information is indicated by a bar code.

The first image forming apparatus for achieving the above-mentioned first object is an image forming apparatus for forming an image on each surface of cut sheets, wherein the image forming apparatus includes reading means which reads cut sheet information affixed to a portion of a cut sheet packaging member for accommodating a plurality of such cut sheets and output means which outputs at least a portion of the cut sheet information read by the reading means.

The second image forming apparatus for achieving the above-mentioned first object is an image forming apparatus for forming an image on each surface of cut sheets which are accommodated in a cut sheet packaging member separable into a lid part and a body part, wherein the image forming apparatus includes reading means which reads cut sheet information affixed to a portion of the cut sheet packaging member, output means which outputs at least a portion of the cut sheet information read by the reading means, a sheet feeding part in which a plurality of cut sheets are set, and a portion to be latched which, when the lid part is separated from the body part of the cut sheet packaging member and the body part is set in the sheet feed portion together with a plurality of cut sheets, engages the body part with the sheet feeding part to prevent the body part from being fed.

In the image forming apparatus of either the first or second image forming apparatus, the third image forming apparatus for achieving the above-mentioned first object is characterized in that a fixed guile and a movable guide which guile the widthwise direction of the cut sheets are provided to a sheet feed opening for the cut sheet and the reading means is provided at the fixed guide side in the inside of the sheet feed opening.

In the image forming apparatus of either the first or second image forming apparatus, the fourth image forming apparatus to achieve the above-mentioned first object is characterized in that a pair of movable guides for guiding the widthwise position of the cut sheets are provided to a sheet feed opening for the cut sheets and a pair of such movable guides are constituted such that when one movable guide approaches the other movable guide, the other movable guide also approaches one movable guide by the same distance and when one movable guide moves away from the other movable guide, the other movable guide also moves away from one movable guide by the same distance, and the reading means is provided in the inside of the sheet feed opening and at a center position between a pair of such movable guides.

In the image forming apparatus of either the first or second image forming apparatus, the fifth image forming apparatus for achieving the above-mentioned first object is characterized in that the image forming apparatus includes an information card mounting part into which a portion which is removed from the cut sheet packaging member and to which the cut sheet information is affixed can be inserted and the reading means is provided to the information card mounting part.

In the image forming apparatus of any one of the first to fifth image forming apparatuses, the sixth image forming apparatus for achieving the above-mentioned first object is characterized in that the output means includes at least one of display means which displays at least a part of the cut sheet information read by the reading means and transmission means which transmits at least a part of the cut sheet information to an image forming control apparatus which controls the image forming apparatus.

The first storage medium which stores an operating program of an image forming control device for achieving the first object stores a program which is characterized by including a transmission/reception control step which allows a transmission/reception part to receive from an image forming apparatus cut sheet information including at least one of model number, kind of sheet, thickness of sheet and unit price of the cut sheets, and a display control step which allows the display part to display at least a part of the cut sheet information received by the transmission/reception part.

In the first storage medium, the second storage medium for achieving the first object stores a program in which the display control procedure allows the display part to display various kinds of information related with at least one cut sheet information out of the cut sheet informations and allows the display part, when the transmission/reception part receives such one cut sheet information, to preferentially display such one received cut sheet information to such various kinds of information.

According to the above-mentioned invention, in the cut sheet packaging member to which the cut sheet information is affixed, when a portion to which such cut sheet information is affixed is mounted in the image forming apparatus, the cut sheet information is read by the image forming apparatus and hence, the labor and time necessary for a user to input the cut sheet information by himself or herself can be eliminated and the erroneous inputting of the cut sheet information can be also eliminated.

Further, even with respect to a cut sheet to which the cut sheet information is affixed, the cut sheet information is read by the image forming apparatus in the same manner and hence, the labor and time necessary for a user to input the cut sheet information by himself or herself can be eliminated and the erroneous inputting of the cut sheet information can be also eliminated.

Further, according to the present invention, the cut sheets are used in a state that the cut sheets are accommodated in the body part of the cut sheet packaging member, and thus the cut sheets are protected from being adhered with dust. Further, at the time of exchanging the cut sheet, the cut sheets are exchanged together with the body part so that the cut sheets can be easily exchanged.

DETAILED DESCRIPTION OF THE PREFERRED EMBODIMENTS

Embodiments of the present invention are explained in detail hereinafter in conjunction with attached drawings.

Figure 1:
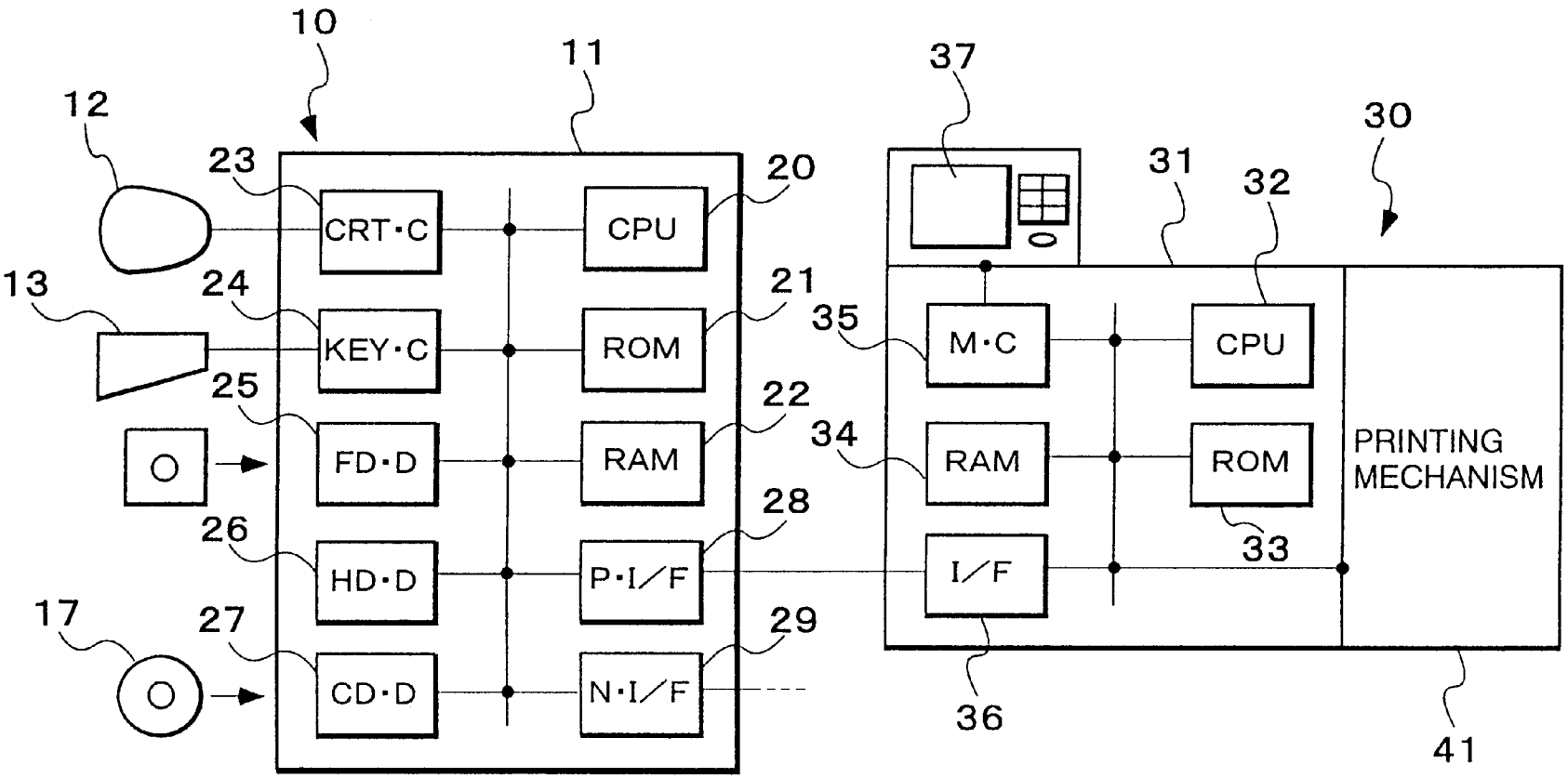
FIG. 1 is a circuit block diagram of an image forming system of the first embodiment according to the present invention.

As shown in FIG. 1, an image forming system of the first embodiment is comprised of a printer host 10 and a printer 30 which performs printing based on a printing command outputted from the printer host 10.

The printer host 10 is comprised of a host body 11, a display device (display part) 12 and a key board 13. The host body 11 includes a CPU 20 which executes various programs, a ROM 21 which stores various data and various programs, a RAM 22 which temporarily stores various data and various programs, a display controller 23 which controls a display device (display part) 12, an input device controller 24 which controls an input device 13 such as a keyboard or a mouse, a floppy disc drive 25, a hard disc drive 26, a CD-ROM drive 27, a printer interface (transmission/reception part) 28, and a network interface 29.

Figure 2:
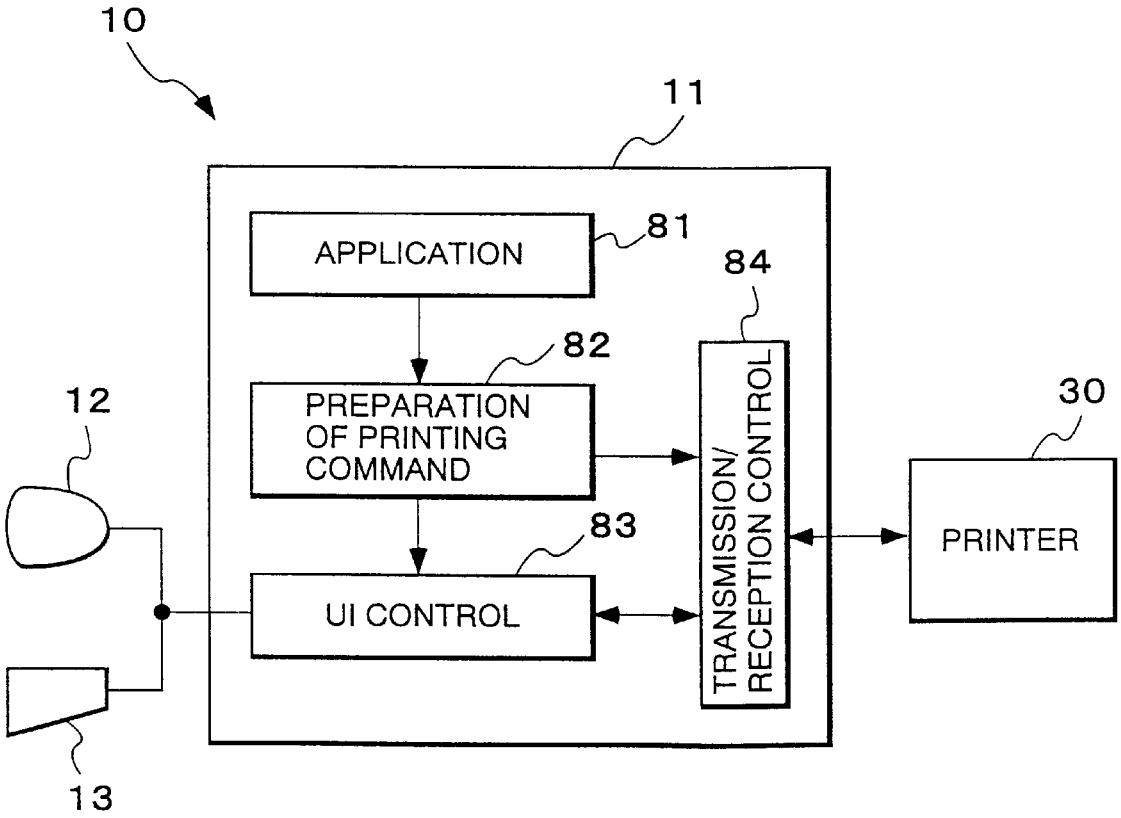
FIG. 2 is a software constitutional view of a printer host as the first embodiment according to the present invention.

As shown in FIG. 2, the host body 11 of the printer host 10 functionally includes an application 81, a printing command preparation part 82 which converts a document prepared by the application 81 into a printing command that the printer 30 can interpret, a user interface control part (display control sequence) 83 which controls the display device 12 and the input device 13 and a transmission/reception control part (transmission/reception control sequence) 84 which controls the transmission/reception of data to and from the printer 30. Any one of these functional elements is provided as a host operating program from the CD-ROM 17 or the like. A program of the CD-ROM 17 is reproduced by the CD-ROM drive 27 and then is installed in the hard disc drive 26 and then is loaded on the RAM 22. Then, the functional elements work when the CPU 20 executes the program.

As shown in FIG. 1, the printer 30 includes a monitor (output means, display means) 37, a printing mechanism 41 and a printing controller 31 which controls these components. The printing controller 31 includes a CPU 32 which executes various programs, a ROM 33 which stores various data and various programs, a RAM 34 which temporarily stores various data and various programs, a monitor controller 35 which controls the monitor 37 and an interface (output means, transmission means) 36.

Figure 3:
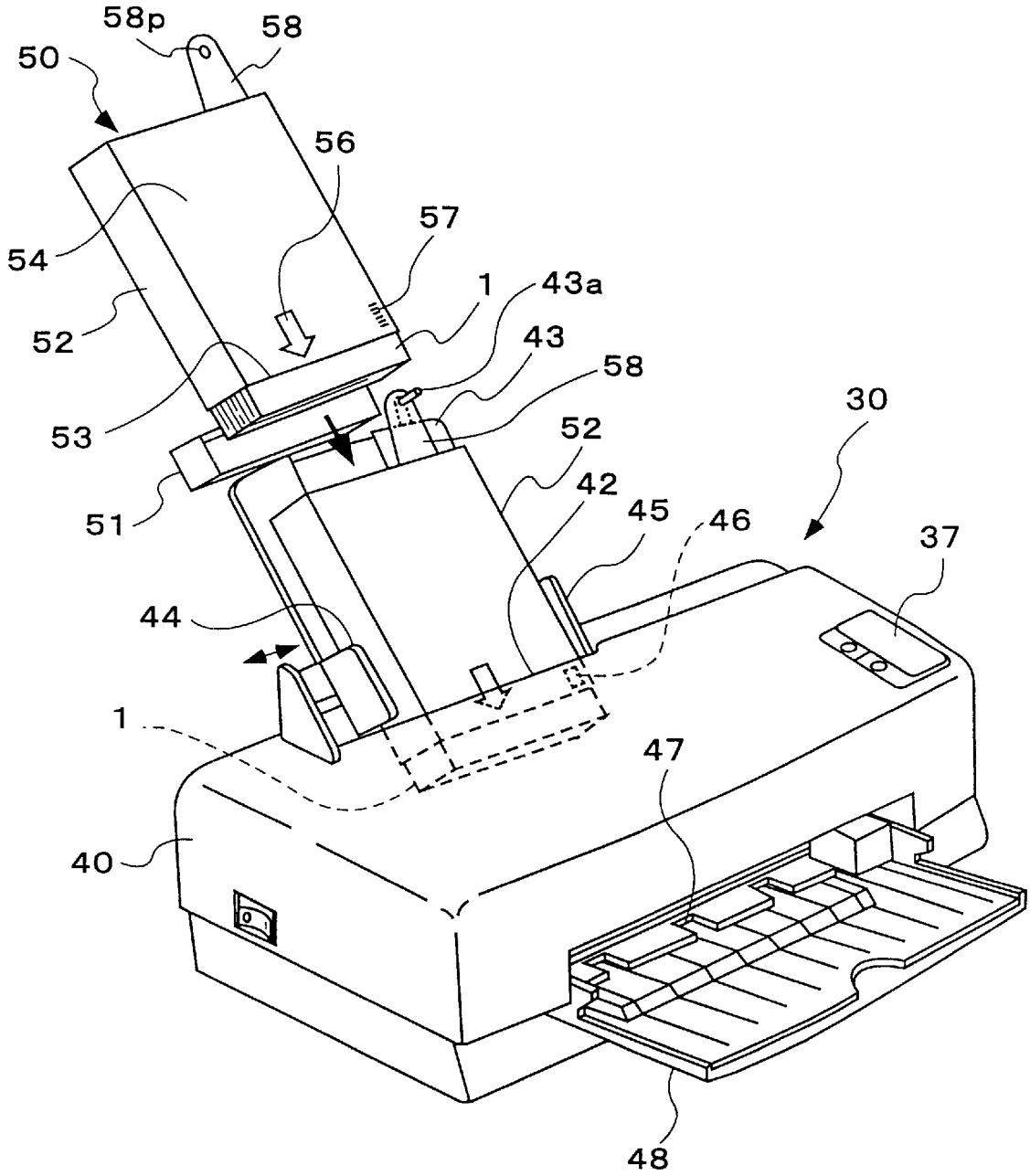
FIG. 3 is a perspective view of a printer and a cut sheet packaging member of the first embodiment according to the present invention.

The printing mechanism 41 and the printing controller 31 are accommodated in a casing 40. As shown in FIG. 3, the casing 40 is provided with a cut sheet feed opening 42 and a cut sheet discharge opening 47. The cut sheet feed opening 42 is provided with a sheet feed tray 43, a movement guide 44 which guides the cut sheet 1 in the widthwise direction of the cut sheet 1 and a fixed guide 45. The sheet feed tray 43 is provided with a latch pin (latch portion) 43*a* which stops a cut sheet packaging member 50 on the sheet feed tray 43. Further, in the inside of the cut sheet feed opening 42, a bar code reader (reading means) 46 is provided. The cut sheet discharge opening 47 is provided with a sheet discharge tray 48.

Subsequently, the first embodiment of the cut sheet packaging member is explained in conjunction with FIG. 4–FIG. 6.

The cut sheet packaging member 50 of this embodiment is made of a vinyl sheet and is formed in a rectangular parallelpiped shape to package a plurality of rectangular cut sheets 1. The cut sheet packaging member 50 is provided with a separation line 53 for dividing the member 50 into a lid part 51 and a body part 52 so as to take out a plurality of cut sheets 1 from the inside thereof. This separation line 53 is formed in a direction perpendicular to the longitudinal direction of the cut sheet packaging member 50. To facilitate the division of the cut sheet packaging member 50 into the lid part 51 and the body part 52, the separation line 53 is made of a separation tape.

Among a plurality of faces which constitute the body part 52, on the face opposite to the lid part 51, a stopper lug 58 which extends in a direction opposite to the lid part 51 is formed. A hole used for latching 58*p* which allows the insertion of the latch pin 43*a* (shown in FIG. 3) of the printer 30 therein is formed in the stopper lug 58.

On one surface 54 of the body part 52, a cut sheet insertion arrow 56 and cut sheet information 57 on the cut sheets 1 packaged in the packaging member are printed. This one surface 54 of the body part 52 is a face which faces the surfaces of the cut sheets 1 accommodated in the inside of the body part 52. The cut sheet insertion arrow 56 is directed from the body part 52 to the lid part 51. Further, the cut sheet information 57 are printed at a position located at a left end as seen in the direction indicated by the arrow 56 and close to the separation line 53.

Figure 5:
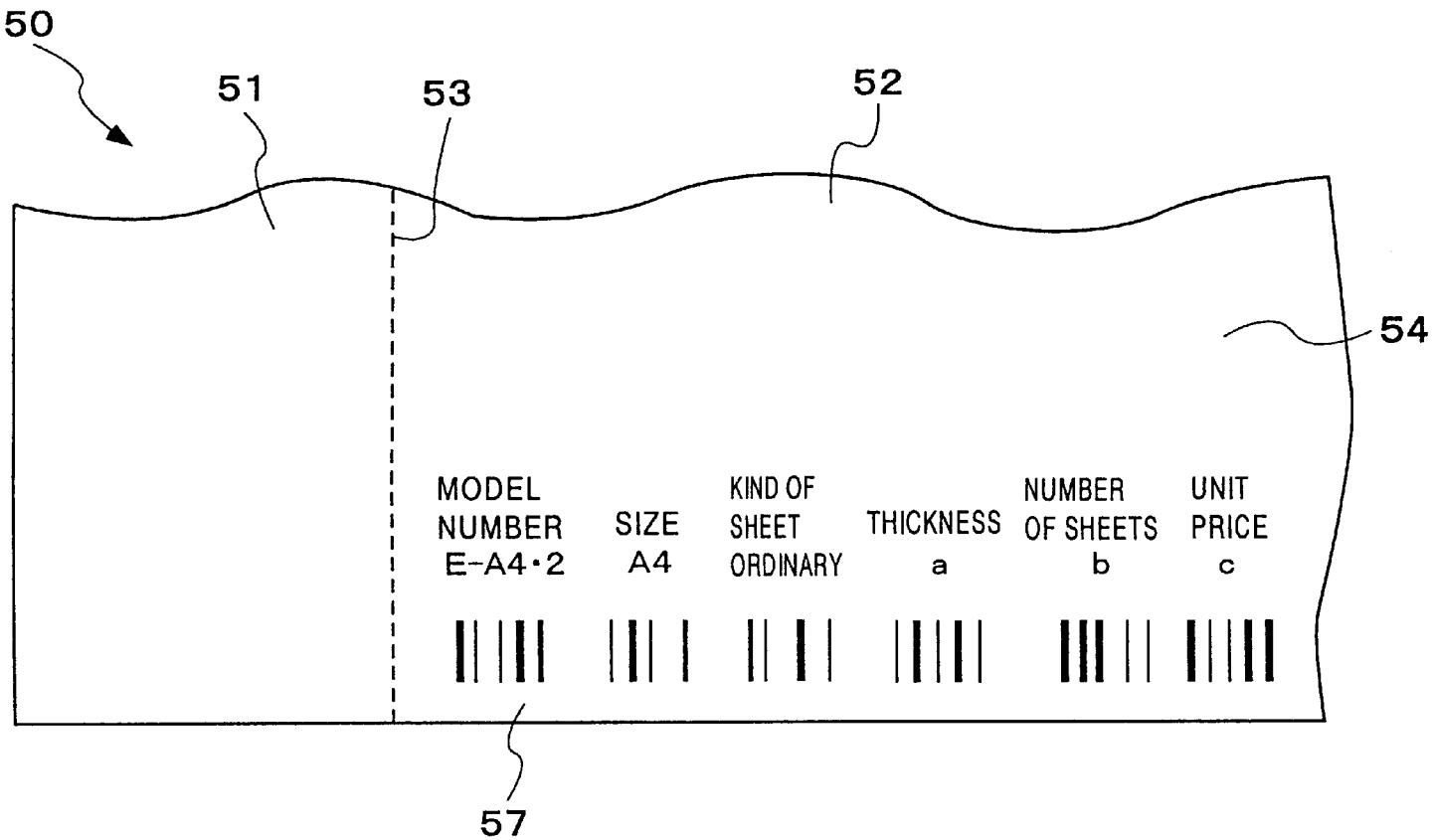
FIG. 5 is an essential plan view of a cut sheet packaging member of the first embodiment according to the present invention.

As shown in FIG. 5, the cut sheet information 57 includes model number, size, kind of sheet, thickness, number of sheets, unit price or the like of the cut sheets. These information are indicated by bar codes together with characters which indicate the contents of information. The reason why the characters are used together with the bar codes is that the user can grasp the cut sheet information with his or her eyes. Respective information are arranged in the direction of the cut sheet insertion arrow 56, that is, in the cut sheet inserting direction.

Figure 6:
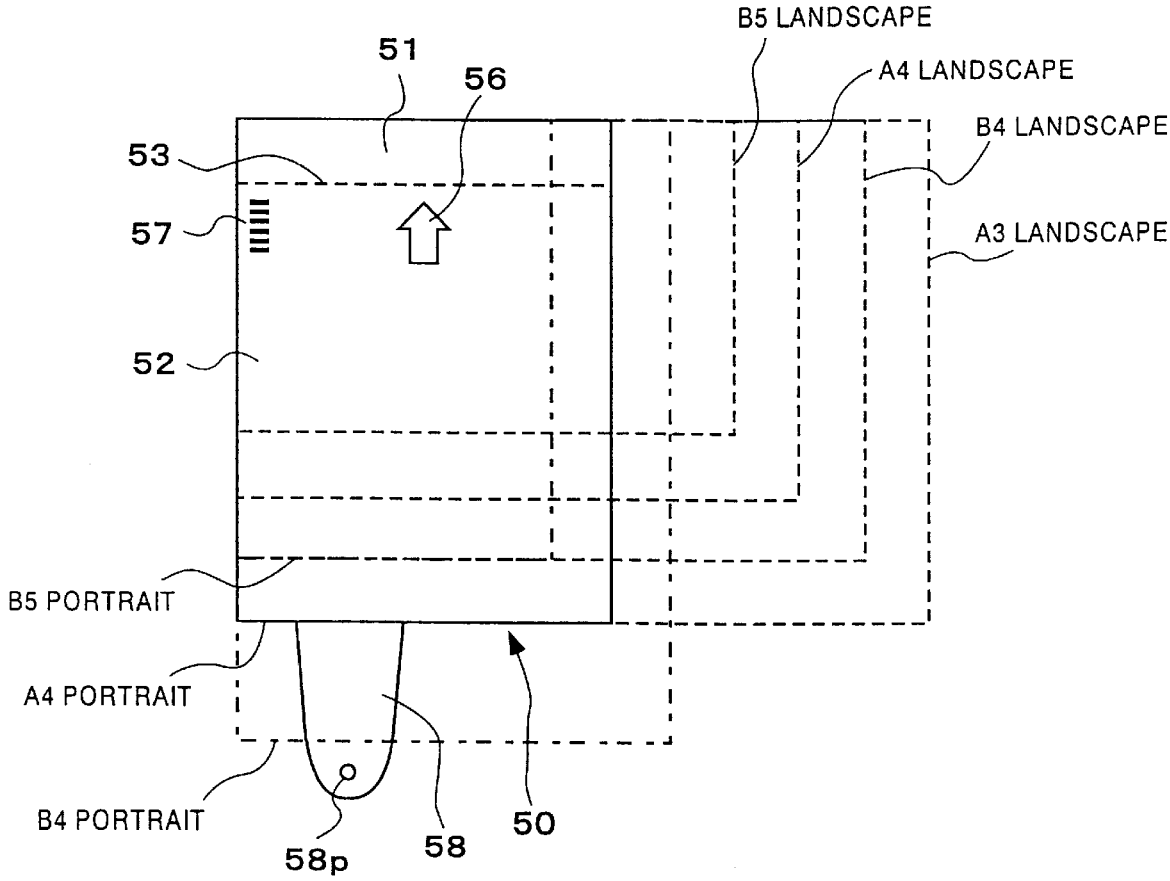
FIG. 6 is an explanatory view showing the positional relationship between cut sheet information and a latching-used hole of a cut sheet packaging member as the first embodiment according to the present invention.

As shown in FIG. 6, the relative positional relationship between the cut sheet information 57 affixed to the body part 52 of the cut sheet packaging member 50 and the latching-used hole 58*a* of the stopper lug 58 formed on the body part 52 is set such that the relationship is not changed even when the size of the cut sheet is changed. This allows to keep unchanged the position of the latch pin 43*a* which engages and stops the body part 52 of the cut sheet packaging member 50 even when the size of the cut sheet 1 is changed.

Subsequently, the manner of operation for printing the cut sheets packaged in the cut sheet packaging member using the above-mentioned image forming system is explained.

Figure 4:
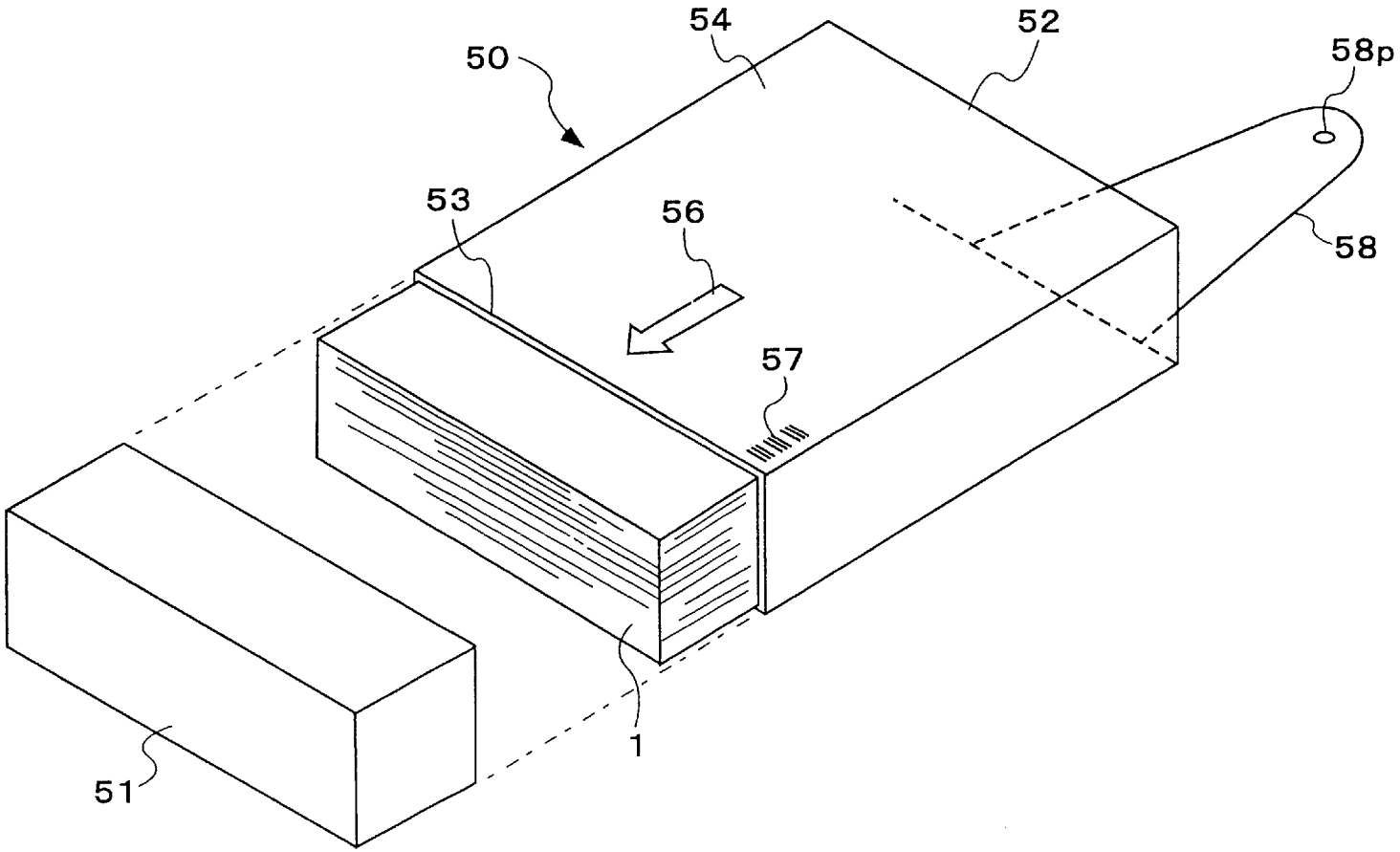
FIG. 4 is a perspective view of a cut sheet packaging member of the first embodiment according to the present invention.

First of all, as shown in FIG. 4, the user cuts the cut sheet packaging member 50 along the separation line 53 and separates the lid part 51 from the body part 52 of the cut sheet packaging member 50. Subsequently, as shown in FIG. 3, the user inserts the latch pin 43*a* of the printer 30 into the latching-used hole 58*p* of the cut sheet packaging member 50. Then, the body part 52 of the cut sheet packaging member 50 and the cut sheet 1 accommodated in the body part 52 are placed on the sheet feed tray 43 such that the cut sheet insertion arrow 56 is directed toward the sheet feed opening 42 of the printer 30. When the body part 52 is placed on the sheet feed tray 43, the body part 52 slides on the sheet feed tray 43 and a distal end portion of the body part 52 and the cut sheets 1 exposed from the body part 52 enter the inside of the sheet feed opening 42 and stop their movement when the stopper lug 58 of the cut sheet packaging member 50 is fully extended. In this step, the cut sheet information 57 affixed to the body part 52 is read by the bar code reader 46 provided in the inside of the sheet feed opening 42. The reason why the cut sheet information 57 is affixed to the fixed guide 45 side of the body part 52 in the state that the cut sheets 1 is inserted into the sheet feed opening 42 and the bar code reader 46 is disposed at the fixed guide 45 side in the inside of the sheet feed opening 42 is that even when the size of the cut sheet 1 is changed, the distance from the fixed guide 45 to the cut sheet information 57 is kept unchanged and hence, the cut sheet information 57 can be read by the bar code reader 46 fixedly secured to a fixed position.

Here, to read the bar code with the bar code reader 46, it is necessary to provide the relative movement of the bar code reader 46 in the bar code arranged direction. In this embodiment, since the bar codes which express the cut sheet information 57 are arranged in the cut sheet insertion direction. Therefore, even when the bar code reader 46 is not moved, in the step for inserting the body part 52 of the cut sheet packaging member 50 into the sheet feed opening 42, the bar codes which express the cut sheet information can be read.

It must be noted that the present invention is not limited to the case that the bar codes which express the cut sheet information are arranged in the cut sheet insertion direction. For example, the bar codes may be arranged in the direction perpendicular to the cut sheet insertion direction. In this case, the bar code reader is relatively moved in the bar code arranged direction.

The cut sheet information read by the bar code reader 46 is temporarily stored in the RAM 34 of the printer 30.

Figure 7:
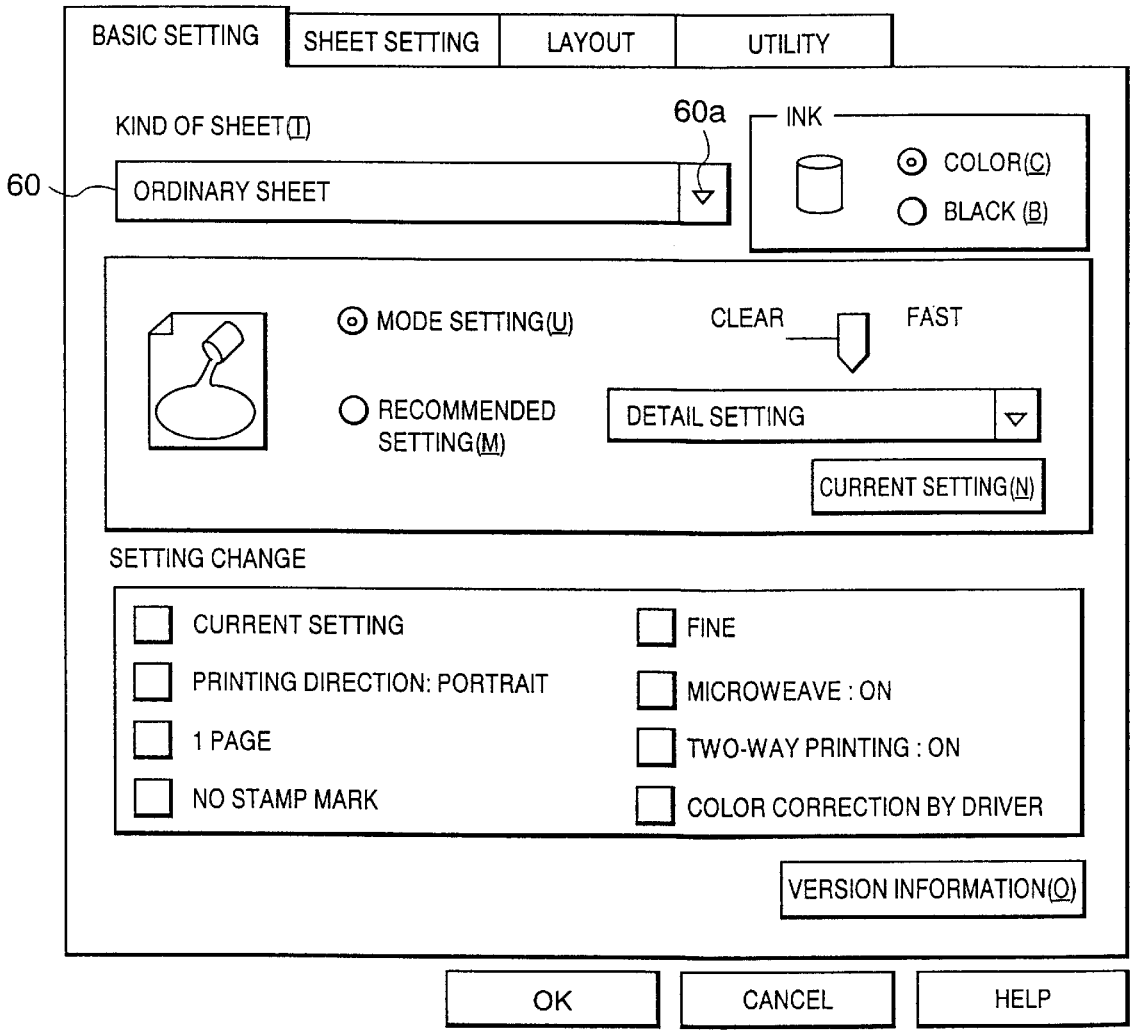
FIG. 7 is an explanatory view showing a printing basic setting screen of a printer host of the first embodiment of the present invention.
Figure 8:
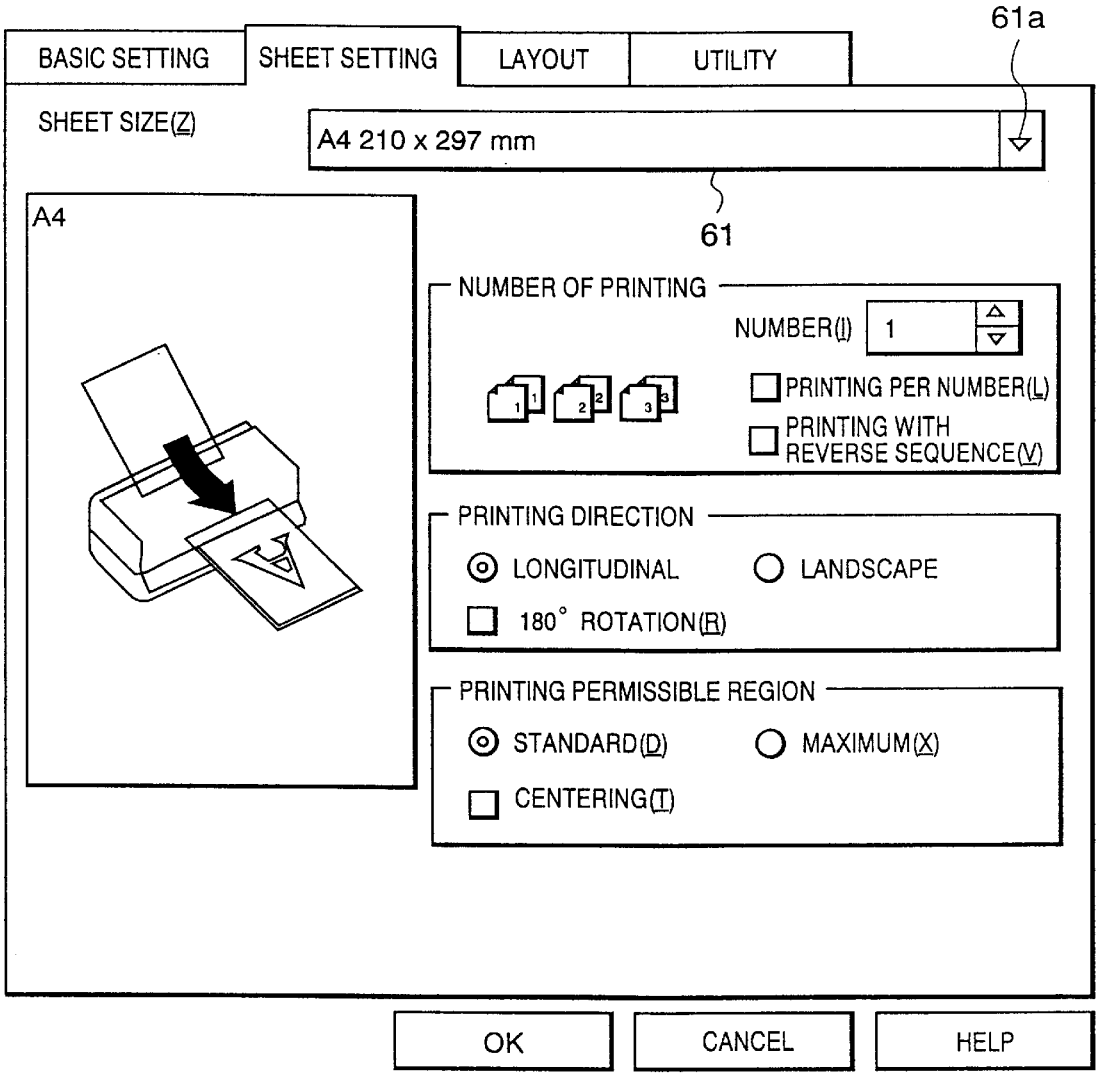
FIG. 8 is an explanatory view showing a printing sheet setting screen of a printer host of the first embodiment of the present invention.

Subsequently, the user sets printing conditions at the printer host 10. In setting the printing conditions, the user interface control part 83 of the printer host 10 commands the display device 12 to display printing condition setting screens as shown in FIGS. 7 and 8. In general, on the basic setting screen shown in FIG. 7, when the user wants to set a kind of sheet, for example, the user clicks an arrow 60*a* in a sheet kind section 60 to make the section 60 perform a pull-down display of a plural kinds of sheets and selects one out of a plural kinds of sheets. Further, on the sheet setting screen shown in FIG. 8, when the user wants to set the size of the sheet, the user clicks an arrow 61*a* of a sheet size section 61 and makes the section 61 perform a pull-down display of a plural sheet sizes and selects one out of a plural sheet size.

To the contrary, in this embodiment, in displaying the printing condition setting screen, the user interface control part 83 of the printer host 10 requests the printer 30 to supply the cut sheet information through the transmission/reception part 84 and takes in the cut sheet information which the printer 30 has acquired and performs the display of the kind of sheet and the size of sheet and the like based on the cut sheet information. That is, in the basic setting screen shown in FIG. 7, the kind of sheet contained in the cut sheet information from the printer 30 is automatically displayed in a sheet kind section 60. Further, in the sheet setting screen shown in FIG. 8, the size of sheet contained in the cut sheet information from the printer 30 is automatically displayed in a sheet size column 61. In this embodiment, in addition to the above-mentioned automatic updating, the manual updating can be performed. In this manual updating, an "updating" button is provided to the printing condition setting screen and the updating is performed when the button is clicked. This manual updating is effective in reducing the unnecessary communication in network connection or the like and in editing documents with the size of sheets which is not set at the printer.

In this manner, according to this embodiment, since the information on the cut sheets is automatically set, labor and time necessary for the user to set the information on the cut sheets into the host 10 by himself or herself can be eliminated and furthermore the erroneous inputting of information can be obviated. Further, various cut sheet information may be displayed on the monitor 37 (shown in FIG. 1) of the printer 30.

By the way, in the case the printer which cannot acquire the cut sheet information is used, even when the printer host 10 requests the printer to supply the cut sheet information, the printer cannot respond to this request. Accordingly, in this embodiment, as in the previously mentioned general case, the function that the user can select various cut sheet information by himself or herself is reserved and when the cut sheet information is transmitted from the printer, the priority is given to the display of this cut sheet information.

Although only the kind of sheet and the size of the sheet are displayed among a plurality of cut sheet information, all cut sheet informations which the printer 30 has obtained, that is, model number, thickness, number of sheets, unit price and the like other than the size and kind of sheets may be displayed. Further, in an opposite case, that is, when the cut sheet information can be obtained from the printer 30, only the setting of these cut sheet informations is performed and the displaying of these cut sheet informations is not performed. However, with respect to the unit price, it is preferable to display such a unit price. Further, in displaying this unit price, the total printing cost which can be obtained from the number of printing may be displayed together with the unit price.

Among the cut sheet information, the thickness of the cut sheets is used for the correction of the moving speed of a printing head of the printer 30, for example, while the number of sheets is used for grasping the remaining number of the cut sheets.

Further, according to this embodiment, there exists an advantageous effect that since the cut sheets 1 can be placed on the sheet feed tray 43 in the state that a plurality of cut sheets 1 are packaged in the body part 52 of the cut sheet packaging member 50, it becomes possible to prevent dust from adhering to the cut sheets 1. When it becomes necessary to change the size of the cut sheets 1 on the sheet feed tray 43, the cut sheets are exchanged together with the body part 52 of the cut sheet packaging member 52. Accordingly, the exchanging operation can be also easily performed.

Further, generally, at the time of taking the cut sheets out from the packaging member and placing a plurality of cut sheets on the sheet feed tray, it is necessary to level a plurality of cut sheets once. However, in this embodiment, since the cut sheets 1 can be placed on the sheet feed tray 43 in the state that a plurality of cut sheets 1 are packaged in the body part 52 of the cut sheet packaging member 50, it is unnecessary to perform such a leveling.

Although the cut sheet packaging member 50 is formed of vinyl sheet in this embodiment, the cut sheet packaging member 50 may be formed of hard resin or metal. In this case, since the cut sheet packaging member 50 has higher rigidity and durability than the cut sheet packaging member 50 formed of the vinyl sheet, the cut sheet packaging member 50 also can play the role of a paper feeding cassette. Further, in this case, at the time of purchasing new cut sheets, the used cut sheet packaging member may be taken back by a vendor and may be recycled.

Figure 9:
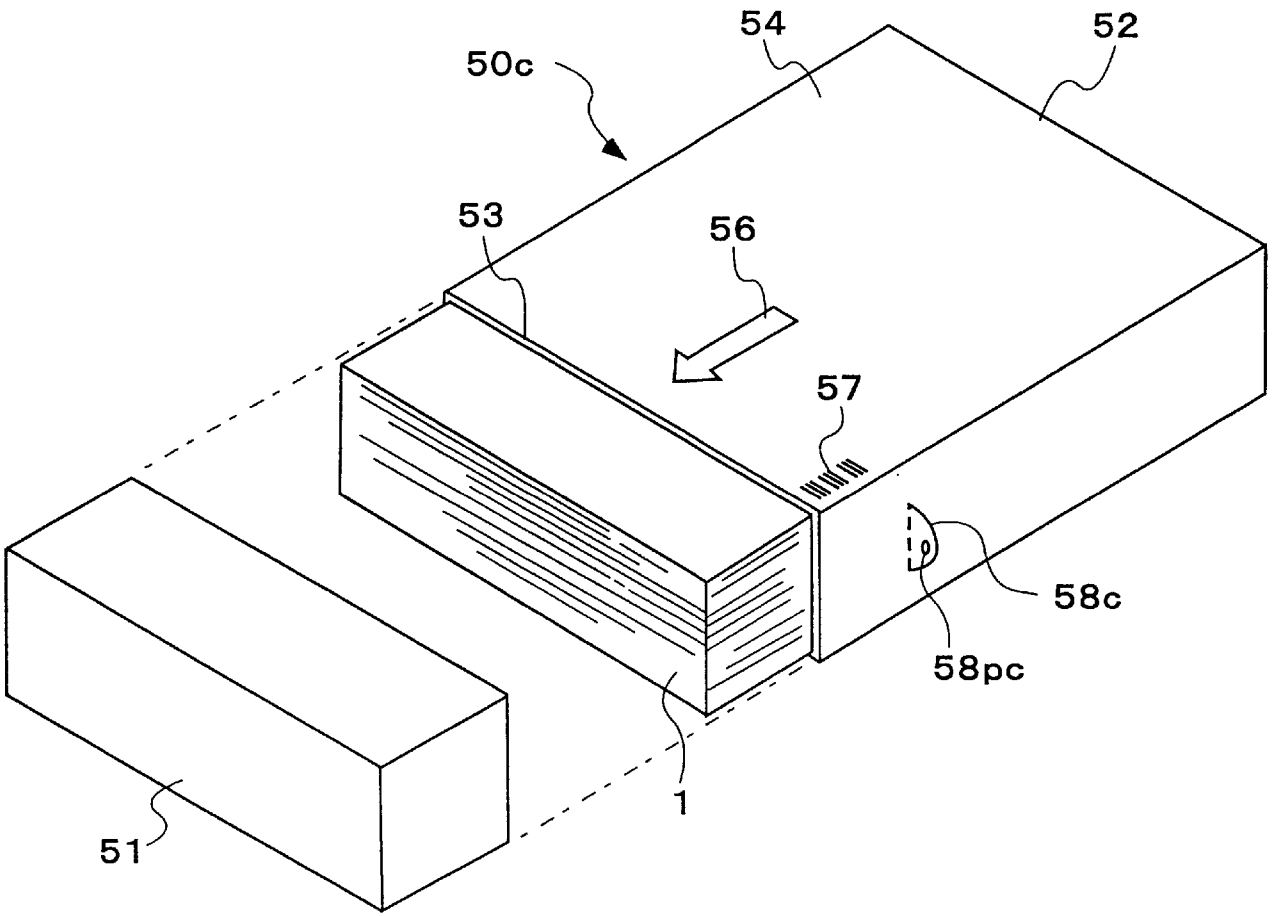
FIG. 9 is a perspective view of a cut sheet packaging member of the second embodiment according to the present invention.

Next, the second embodiment of the cut sheet packaging member is explained in conjunction with FIG. 9.

A cut sheet packaging member 50*c* of this embodiment has the same basic constitution as that of the first embodiment and only differs in the position of the stopper lug. A stopper lug 58*c* of the cut sheet packaging member 50*c* of this embodiment is, among a plurality of faces constituting a body part 52, formed on the left side face of a cut sheet insertion arrow 56 as you face it. That is, the stopper lug 58*c* is formed on the face at the fixed guide 45 side of the printer 30 shown in FIG. 3. This stopper lug 58*c* is also provided with a latching-used hole 58*pc*.

In this case, a latch pin which is engaged with the body part 52 for latching is formed on the fixed guide of the printer.

In this manner, since the stopper lug is provided for preventing the body part of the cut sheet packaging member from being fed to the printer together with the cut sheets, the stopper lug can be equipped on any portion so long as the portion is a part of the body part. However, as mentioned previously in conjunction with FIG. 6, it is preferable that the position of the latching-used hole is kept unchanged even when the size of the cut sheet is changed.

Figure 10:
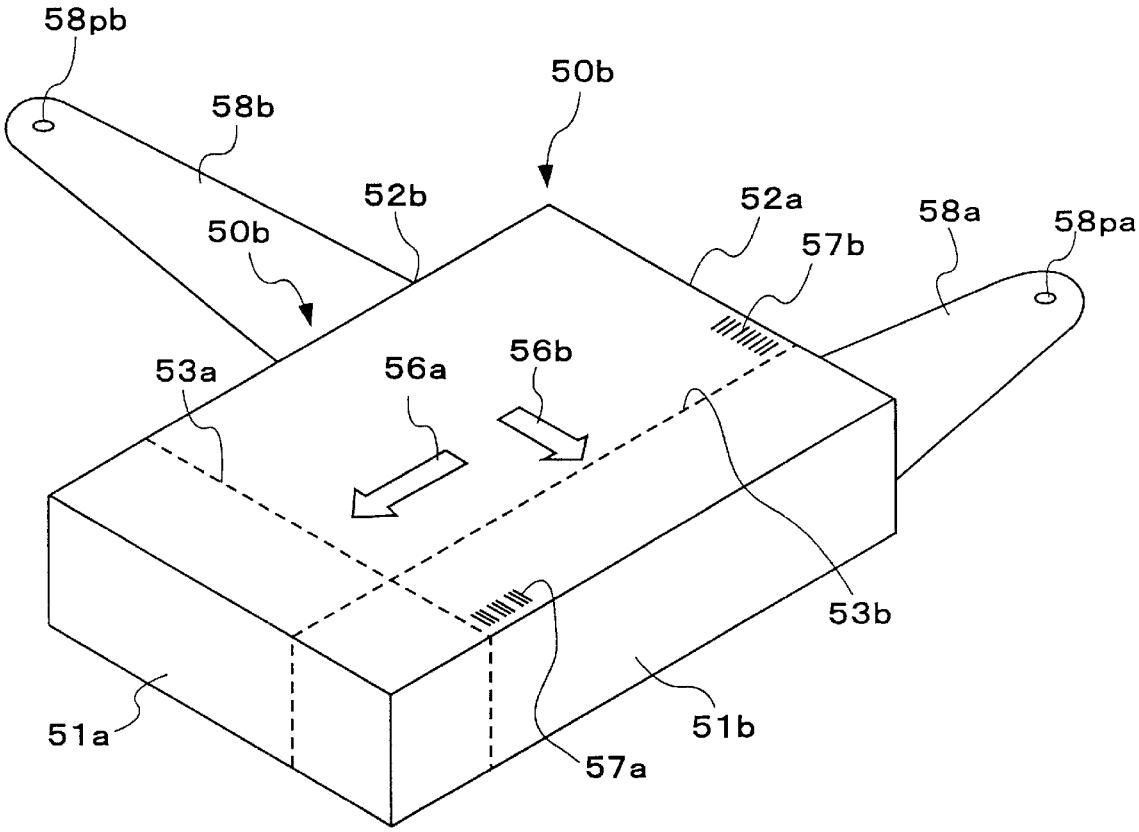
FIG. 10 is a perspective view of a cut sheet packaging member of the third embodiment according to the present invention.
Figure 11:
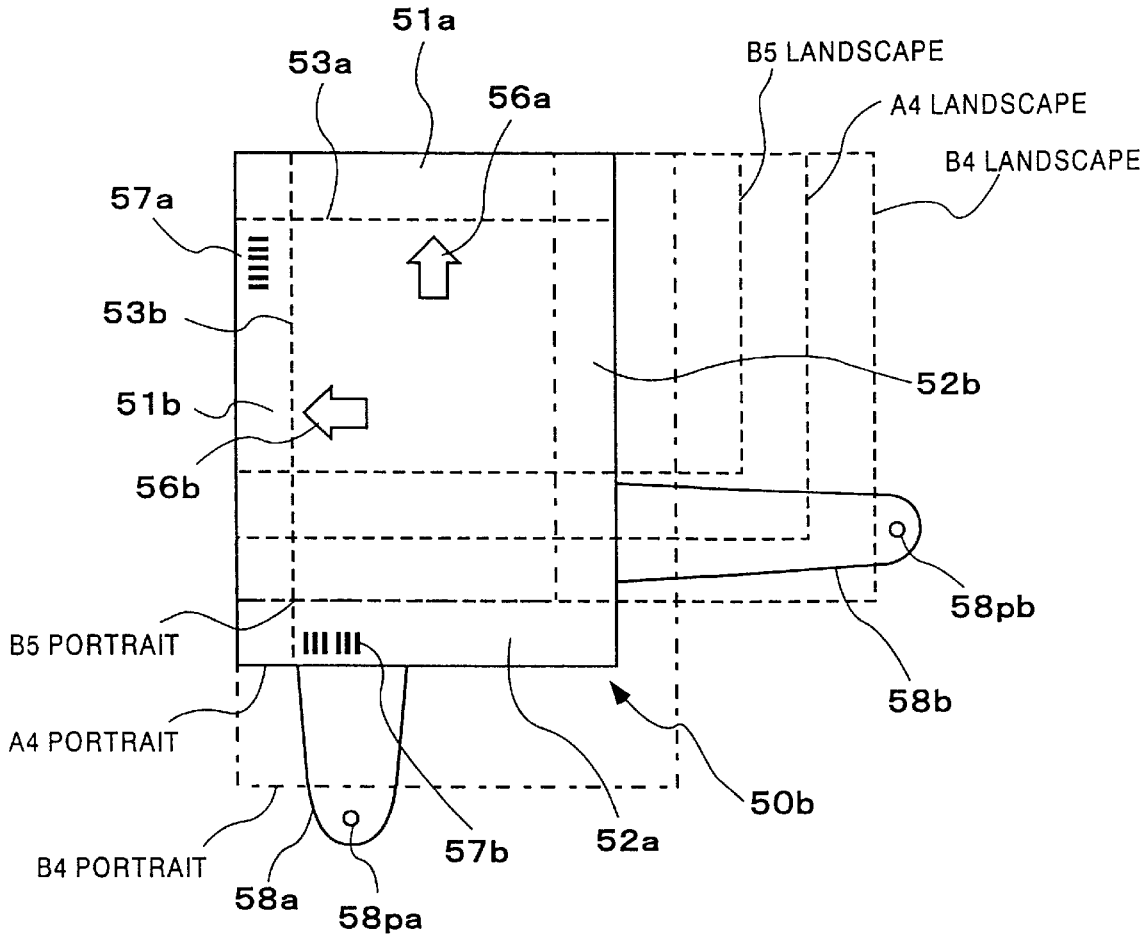
FIG. 11 is an explanatory view showing the positional relationship between cut sheet information and a latching-used hole of a cut sheet packaging member as the third embodiment according to the present invention.

Then, the third embodiment of the cut sheet packaging member is explained in conjunction with FIGS. 10 and 11.

Although it is assumed that in the first and second embodiments the cut sheet inserting direction is the longitudinal direction of the cut sheets, that is, the cut sheets are placed in portrait orientation, in this third embodiment placing the cut sheets in landscape orientation is assumed.

As shown in FIG. 10, in a cut sheet packaging member 50*b* of this embodiment, a first separation line 53*a* is formed parallel to the lateral direction of cut sheets such that a first lid part 51*a* is present at a position corresponding to a longitudinal end portion of the rectangular cut sheets and a first body part 52*a* is present at a side corresponding to an opposite longitudinal end of the cut sheets. Further, a second separation line 53*b* is formed parallel to the longitudinal direction of the cut sheets such that a second lid part 51*b* is present at a position corresponding to a lateral end portion of the cut sheets and a second body part 52*b* is present at a side corresponding to an opposite lateral end of the cut sheets.

As cut sheet insertion arrows, a first cut sheet insertion arrow 56*a* which is directed from the first body part 52*a* to the first lid part 51*a* and a second cut sheet insertion arrow 56*b* which is directed from the second body part 52*b* to the second lid part 51*b* are respectively printed on the first body part 52*a* and the second body part 52*b*.

Further, with respect to cut sheet information, first cut sheet information 57*a* and second cut sheet information 57*b* are respectively printed at a position disposed at the left end as seen in the direction indicated by the first cut sheet insertion arrow 56*a* and close to the first separation line 53*a* and at a position disposed at the left end as seen in the direction indicated by the second cut sheet insertion arrow 56*b* and close to the second separation line 53*b*.

Further, with respect to stopper lugs, among faces which constitute the first body part 52*a*, a first stopper lug 58*a* is formed on the face opposite to the first lid part 51*a*, while, among faces which constitute the second body part 52*b*, a second stopper lug 58*b* is formed on the face opposite to the second lid part 51*b*. A first latching-used hole 58*pa* and a second latching-used hole 58*pb* are respectively formed in the first stopper lug 58*a* and the second stopper lug 58*b*.

As shown in FIG. 11, the relative positional relationship between first cut sheet information 57*a* and the first latching-used hole pa is made equal to the relative positional relationship between second cut sheet information 57*b* and the second latching-used hole pb. Further, in the same manner as the first embodiment, these relative positional relationships are set such that they are kept unchanged even when the size of the cut sheets is changed. That is, the positional relationship between the cut sheet information and the latching-used holes are kept equal even when the cut sheets are used in either portrait orientation or landscape orientation, or the size of the cut sheets is changed.

For example, when the cut sheets are used in portrait orientation, the first lid part 51*a* is separated from the first body part 52*a* and the first body part 52*a* and the cut sheets contained in the first body part 52*a* are placed on the sheet feed tray 43 such that the first cut sheet insertion arrow 56*a* is directed toward the sheet feed opening 42 of the printer 30. Further, when the cut sheets are used in landscape orientation, the second lid part 51*b* is separated from the second body part 52*b* and the second body part 52*b* and the cut sheets contained in the second body part 52*b* are placed on the sheet feed tray 43 such that the second cut sheet insertion arrow 56*b* is directed toward the sheet feed opening 42 of the printer 30. Thereafter, in both cases, as in the case of the first embodiment, the first cut sheet information 57*a* and the second cut sheet information 57*b* are read by the bar code reader 46 of the printer 30.

As mentioned above, in this embodiment, in the case that the cut sheets are used in portrait orientation as well as in the case that the cut sheets are used in landscape orientation, the body parts 52*a*, 52*b* can be placed on the sheet feed tray 43 together with the cut sheets, in both cases, the cut sheet information 57*a*, 57*b* printed on the body parts 52*a*, 52*b* can be read by the printer 30.

Although the first cut sheet information 57*a* and the second cut sheet information 57*b* of this embodiment are both identical with the cut sheet information 57 of the first embodiment, the first cut sheet information may include information that the cut sheets are placed in portrait orientation and the second cut sheet information may include information that the cut sheets are placed in landscape orientation.

Subsequently, the fourth embodiment of the cut sheet packaging member is explained in conjunction with FIG. 12.

In a cut sheet packaging member 50*d* of this embodiment, as in the case of the first embodiment, a separation line 53 which divides the cut sheet packaging member 50*d* into a lid part 51 and a body part 52 is formed. On one face 54 of the body part 52, a cut sheet insertion arrow 56 which is directed from the body part 52 to the lid part 51 is printed. Among faces which constitute the body part 52, a stopper lug 58 is formed on the surface opposite to the first lid part 51.

In this embodiment, to one surface 54 of the body part 52, an information card 59 on which cut sheet information 57 is printed is adhered at a position disposed at a left side as seen in the direction indicated by the cut sheet insertion arrow 56 and close to the separation line 53. This information card 59 is made of a so-called "peel-off sheet" and can be easily peeled off.

So long as the information card 59 is not removed from the body part 52, the cut sheet packaging member 50*d* of this embodiment is used in the same manner as the first embodiment. Further, when the information card 59 is removed from the body part 52, a printer of the second embodiment which will be explained hereinafter is used.

Figure 13:
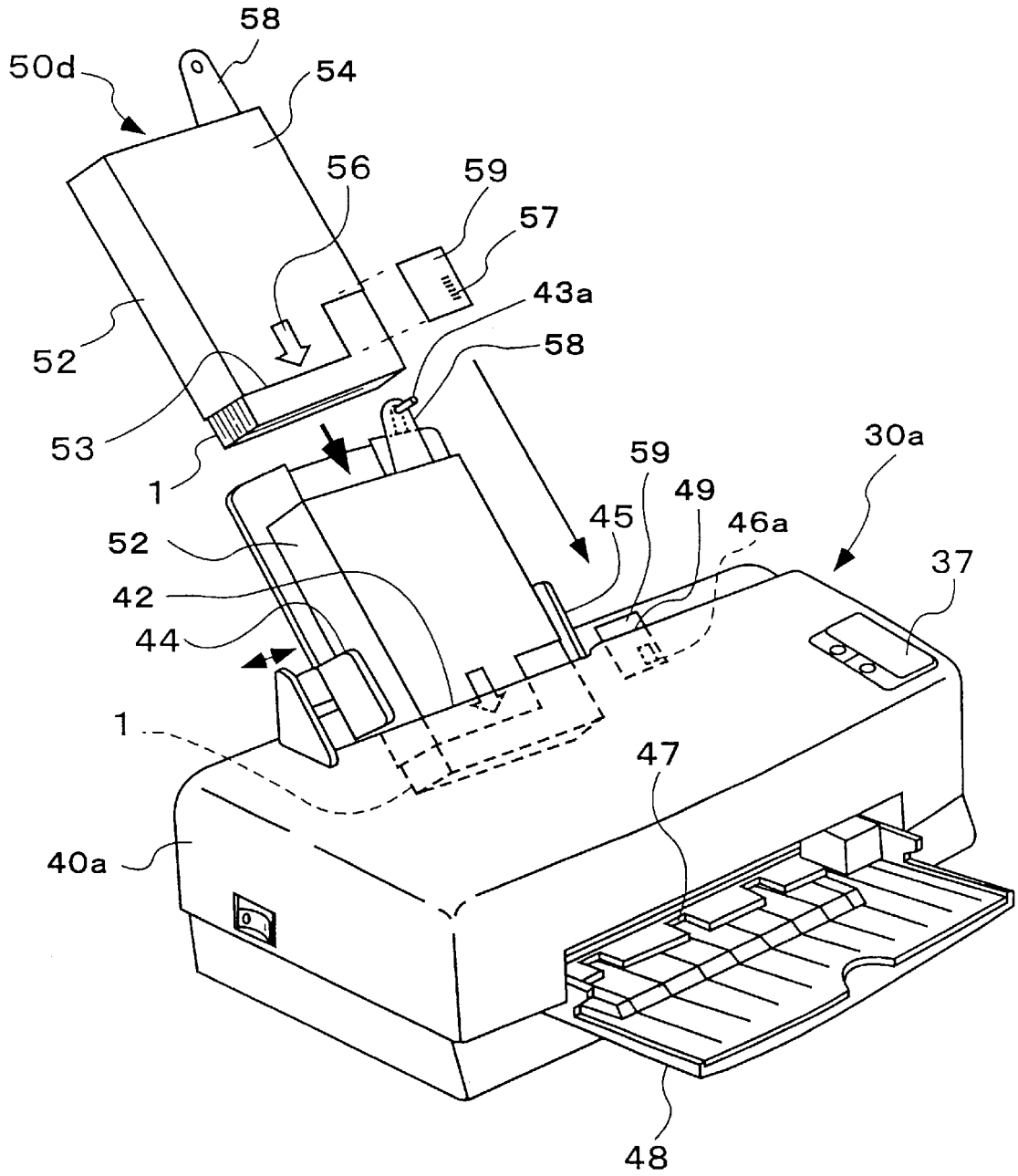
FIG. 13 is a perspective view showing a cut sheet packaging member of the fourth embodiment and a printer of the second embodiment according to the present invention.

As shown in FIG. 13, as in the case of the printer 30 of the first embodiment, a casing 40*a* of a printer 30*a* of the second embodiment is provided with a cut sheet feed opening 42 and a cut sheet discharge opening 47. The cut sheet feed opening 42 includes a sheet feed tray 43 and a movable guide 44 and a fixed guide 45 which guide the position of the cut sheets 1 in the widthwise direction. A latch pin 43*a* is formed on the sheet feed tray 43. The cut sheet discharge opening 47 is provided with a sheet discharge tray 48. The casing 40*a* is further provided with an information card inserting opening (information card inserting portion) 49. In the inside of the information card inserting opening 49, a bar code reader 46*a* is disposed. When the information card 59 which is peeled off from the body part 52 is inserted into the information card inserting opening 49, cut sheet information 57*c* printed on the information card 59 is read by the bar code reader 46*a*.

With respect to the cut sheet packaging member 50*d* of the fourth embodiment, to allow both of the printer 30 of the first embodiment and the printer 30*a* of the second embodiment to read the cut sheet information 57, an information card 59 is formed on a portion which is disposed at the left side as seen in the direction indicated by the cut sheet insertion arrow 56 and close to the separation line. However, when the cut sheet packaging member 50*d* is used only for the printer 30*a* of the second embodiment, the information card 59 may be adhered to any portion of the cut sheet packaging member 50*d*.

Further, although the information card 59 is used after peeling off the information card 59 from the body part 52 in the cut sheet packaging member 50*d* of the fourth embodiment, cut sheet information may be printed on a portion of the body part 52 and then this portion may be separated for use as an information card.

Figure 14:
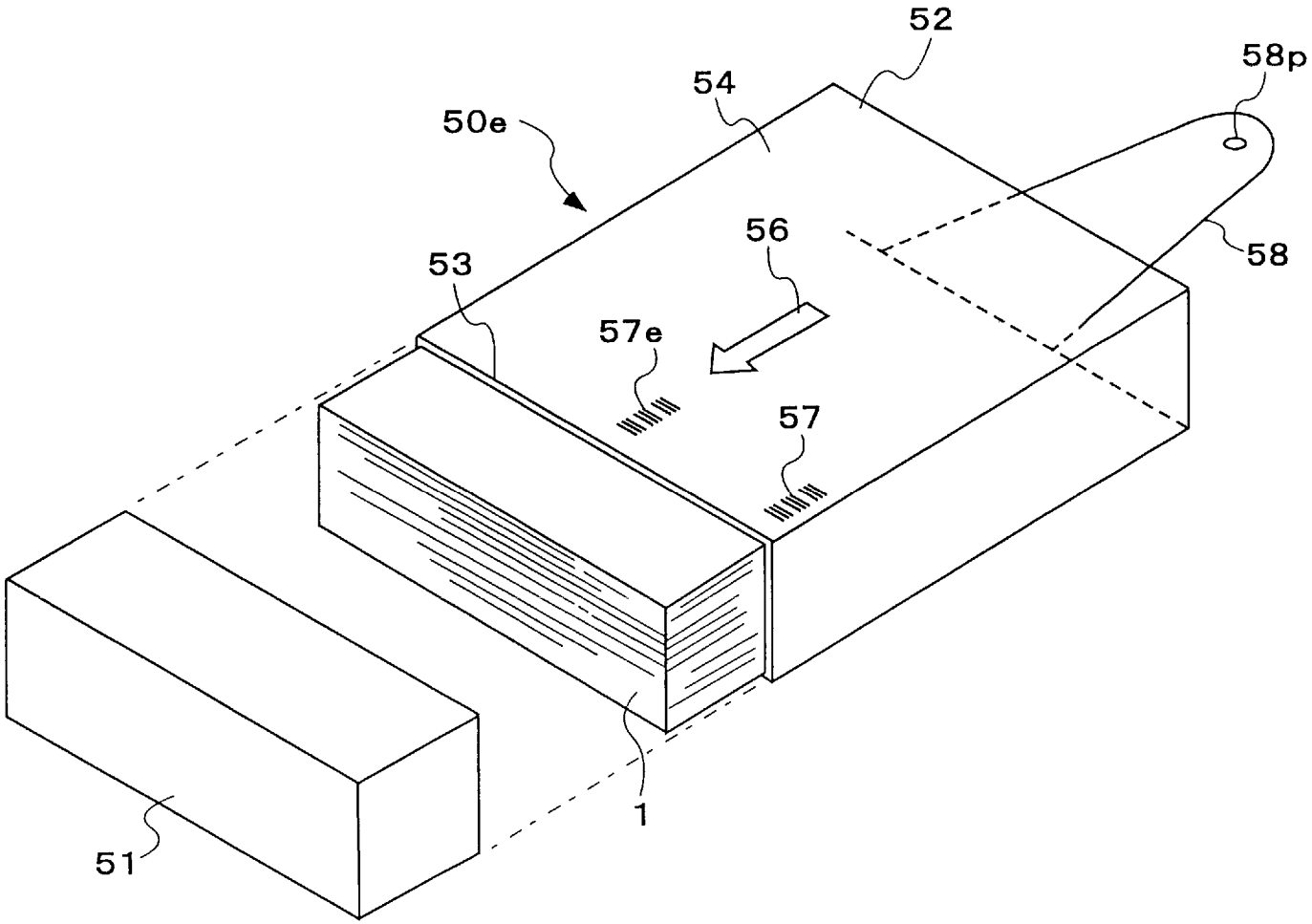
FIG. 14 is a perspective view of a cut sheet packaging member of the fifth embodiment according to the present invention.

Subsequently, the fifth embodiment of the cut sheet packaging member is explained in conjunction with FIG. 14.

A cut sheet packaging member 50*e* of this embodiment is a modification of the cut sheet packaging member 50 of the first embodiment which has been explained in conjunction with FIG. 4. In this embodiment, on one face 54 of a body part 52, a cut sheet insertion arrow 56 and cut sheet informations 57, 57*e* are printed. Among these two cut sheet informations, one cut sheet information 57 is disposed at the same position as that of the first embodiment. That is, one cut sheet information 57 is printed at a left end position as seen in the direction indicated by the arrow 56 and close to a separation line 53. Further, the other cut sheet information 57*e* is printed at the center of the cut sheet packaging member 50*e* in the widthwise direction perpendicular to the direction indicated by the arrow 56 and close to the separation line 53. The contents of these two cut sheet informations 57, 57*e* are same.

The cut sheet packaging member 50e of this fifth embodiment considers the use of a printer of the third embodiment explained hereinafter.

Figure 15:
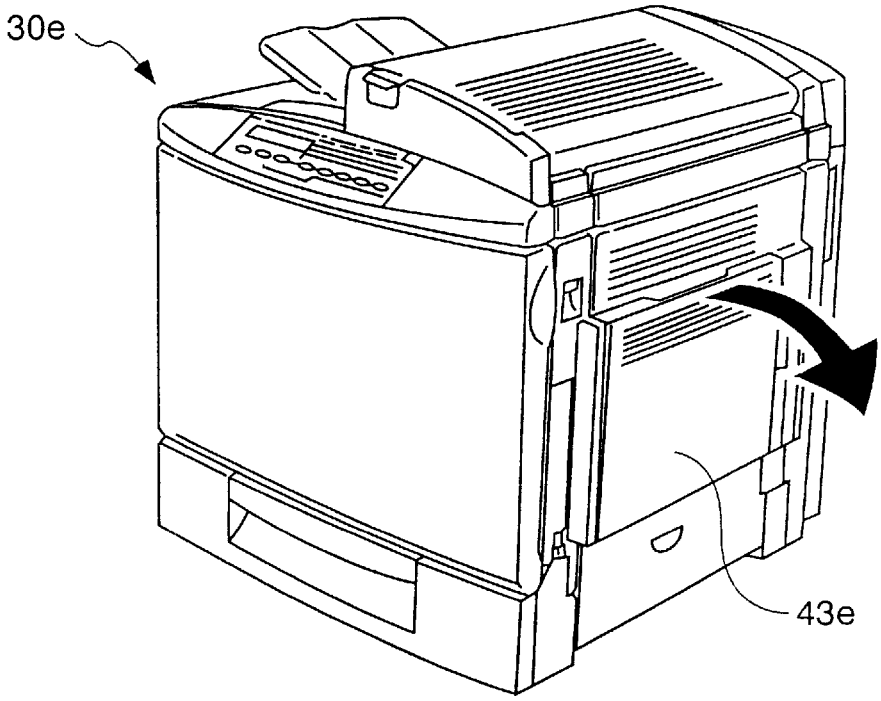
FIG. 15 is a perspective view of a printer of the third embodiment according to the present invention.
Figure 16:
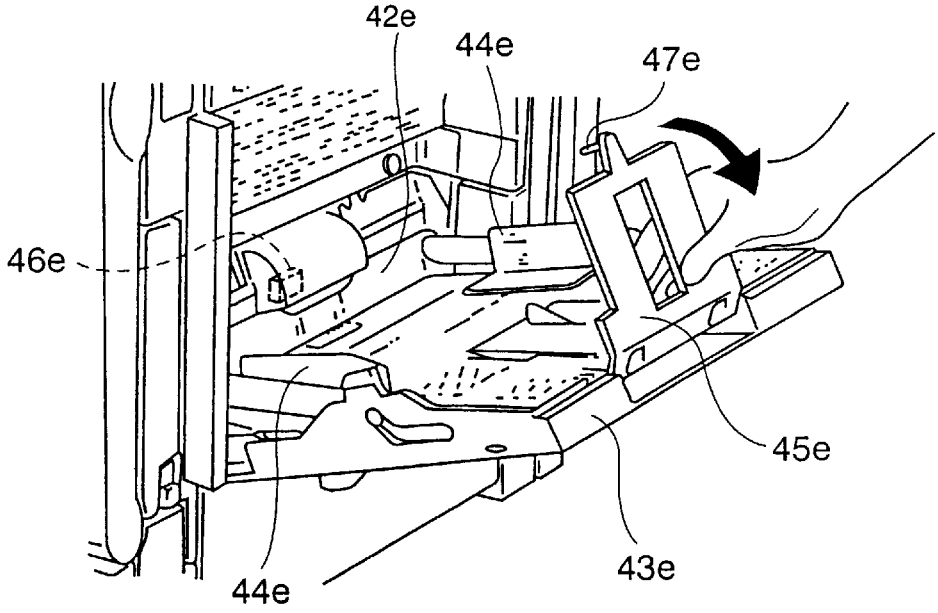
FIG. 16 is a perspective view of a printer feeding part of the third embodiment according to the present invention.

As shown in FIGS. 15 and 16, the printer 30*e* of the third embodiment is different from the printer 30 of the first embodiment on a point that the sheet guide mechanism of the sheet feed portion of the printer 30 of the first embodiment is of a side adjustment type while a sheet guide mechanism of a sheet feed portion of the printer 30*e* of the third embodiment is of a center adjustment type. As shown in FIG. 16, the sheet feed portion of the printer 30*e* of this embodiment includes a main sheet feed tray 43*e,* an extension sheet feed tray 45*e,* a pair of movable guiles 44*e* for guiding the widthwise position of the cut sheets and a bar code reader 46*e* mounted in the inside of the cut sheet feed opening 42*e.* To an end portion of the extension sheet feed tray 45*e,* a latch pin 47*e* is provided.

These movable guides 44*e* are constituted such that when one movable guide 44*e* approaches the other movable guide 44*e,* the other movable guide 44*e* also approaches one movable guide 44*e* by the same distance, while when one movable guide 44*e* moves away from the other movable guide 44*e,* the other movable guide 44*e* also moves away from one movable guide 44*e* by the same distance. Accordingly, a pair of movable guides 44*e* are moved using the widthwise center of the sheet feed opening 42*e* as the reference. The bar code reader 46*e* is disposed at the reference position of the movement of a pair of movable guides 44*e,* 44*e,* that is, at the widthwise center of the sheet feed opening 42*e.*

Figure 17:
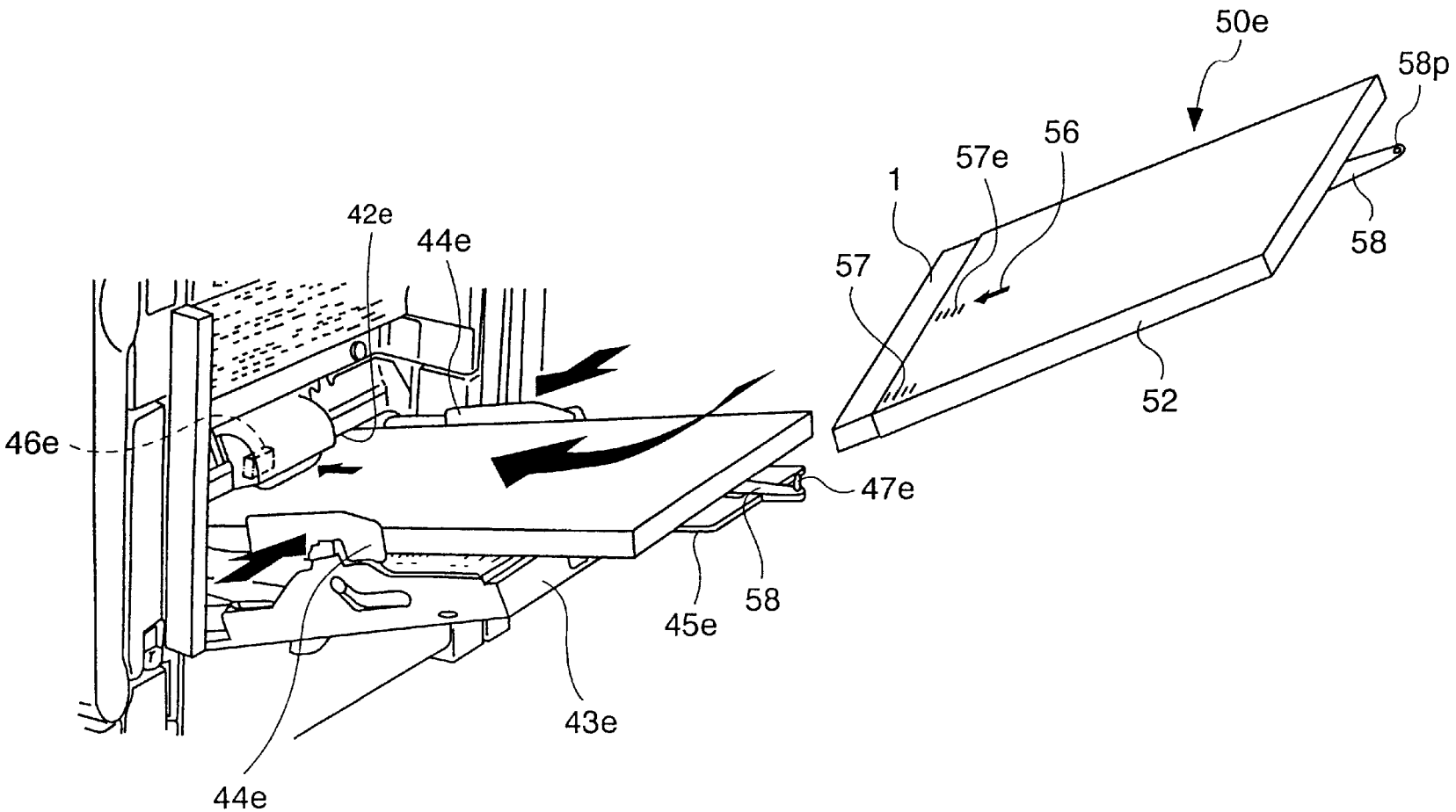
FIG. 17 is a perspective view of a printer feeding part of the third embodiment and a cut sheet packaging member of the fifth embodiment according to the present invention.

In this embodiment, when the user wants to print the cut sheets packaged in the cut sheet packaging member 50*e* by the printer 30*e,* first of all, as shown in FIG. 15, the main sheet feed tray 43*e* is opened. Thereafter, as shown in FIG. 16, the extension feed tray 45*e* is opened. Then, as shown in FIG. 17, the latch pin 47*e* of the printer 30*e* is inserted into the latching-used hole 58*p* of the cut sheet packaging member 50*e.* Subsequently, the body part 52 of the cut sheet packaging member 50*e* and the cut sheets 1 contained therein are placed on the sheet feed trays 43*e,* 45*e* such that the cut sheet insertion arrow 56 is directed toward the sheet feed opening 42*e* of the printer 30*e.* When the body part 52 is placed on the sheet feed trays 43*e,* 45*e,* the body part 52 slides on the sheet feed trays 43*e,* 45*e* and a distal end portion of the body part 52 and the cut sheets 1 exposed from the body part 52 enter the inside of the sheet feed opening 42*e* and are stopped at a point of time when the stopper lug 58 of the cut sheet packaging member 50*e* is fully extended. In this step, out of the cut sheet information 57, 57*e* affixed to the body part 52, the cut sheet information 57*e* printed at the center of the cut sheet packing member 50*e* is read by the bar code reader 46*e* disposed in the inside of the sheet feed opening 42*e.* The cut sheet information 57*e* read by the bar code reader 46*e* is substantially processed in the same manner as the first embodiment.

In the cut sheet packaging member 50*e* of this embodiment, since the cut sheet information 57 is also printed at the same position as the cut sheet packaging member 50 of the first embodiment, it is needless to say that the cutting sheet packaging member 50*e* of this embodiment is applicable to a printer which adopts a sheet guide mechanism of the side adjustment type as in the case of the first embodiment. Further, although the cut sheet informations are printed at two portions in this embodiment, assuming that the cut sheet packaging member 50*e* of this embodiment is used only for a printer which adopts a sheet guide mechanism of the center adjustment type, the cut sheet information may be printed only on the widthwise center of the cut sheet packaging member. Further, the cut sheet information affixed to the widthwise center of the cut sheet packaging member may be applied to the cut sheet packaging members of the above-mentioned second, third and fourth embodiments. However, in applying such cut sheet information to the cut sheet packaging member of the third embodiment, it becomes necessary to affix the cut sheet information to the widthwise center of the cut sheet packaging member when the cut sheets are placed in portrait orientation as well as when the cut sheets are placed in landscape orientation. Further, in applying such cut sheet information to the cut sheet packaging member of the fourth embodiment, it becomes necessary to adhere the information card on which the cut sheet information is printed, to the widthwise center of the cut sheet packaging member.

Figure 18:
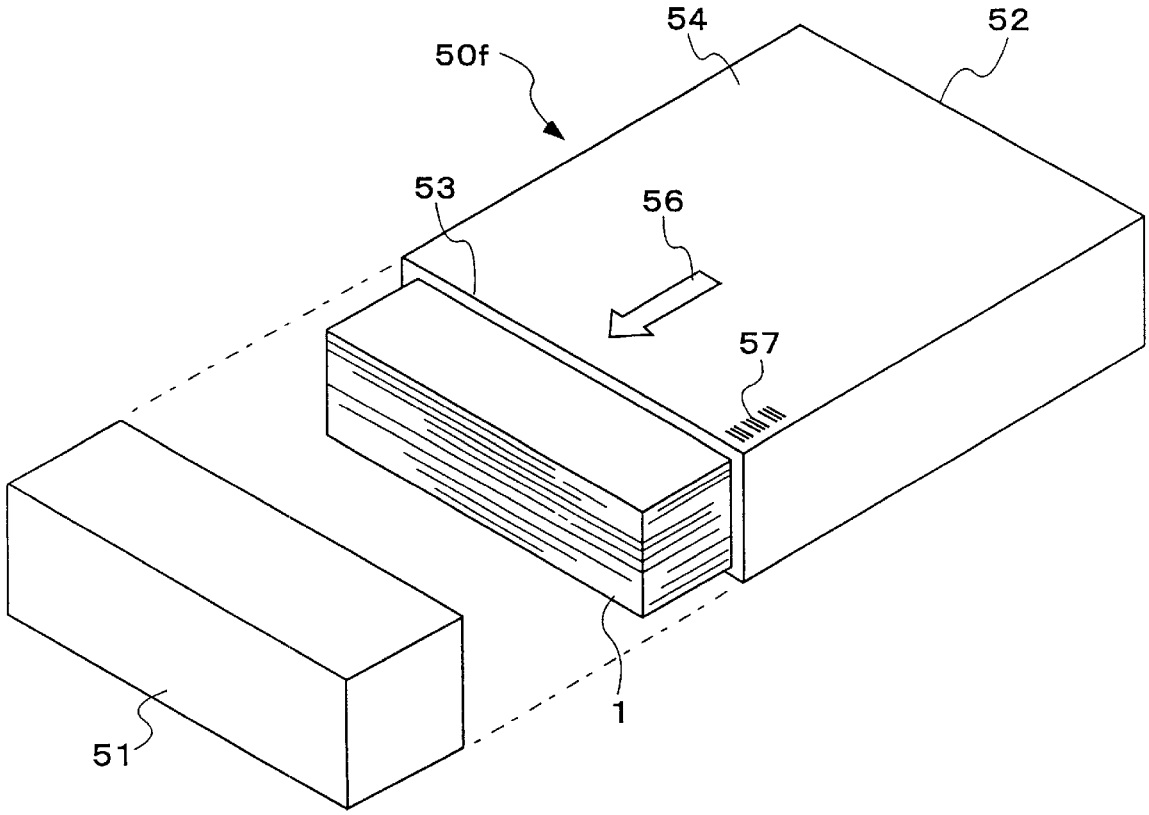
FIG. 18 is a perspective view of a cut sheet packaging member of the sixth embodiment according to the present invention.

Subsequently, the sixth embodiment of the cut sheet packaging member is explained in conjunction with FIG. 18.

A cut sheet packaging member 50*f* of this embodiment is a modification of the cut sheet packaging member 50 of the first embodiment explained using FIG. 4 and is made of cardboard (other thick sheet, hard paper or the like). This cut sheet packaging member 50*f* substantially has the same constitution as that of the cut sheet packaging member 50 of the first embodiment with the exception that the cut sheet packaging member 50*f* is not provided with the stopper lug 58 of the cut sheet packaging member 50 of the first embodiment. However, in this embodiment, since the cut sheet packaging member 50*f* is made of cardboard, a separation line 53 is made of perforations so as to facilitate the dividing of the cut sheet packaging member 50*f* into a lid part 51 and a body part 52.

Since this embodiment has substantially the same constitution as that of the first embodiment with the exception that this embodiment has no stopper lug, this embodiment can enjoy the same advantageous effects as those of the first embodiment except for the advantageous effect brought about by the stopper lug.

Figure 19:
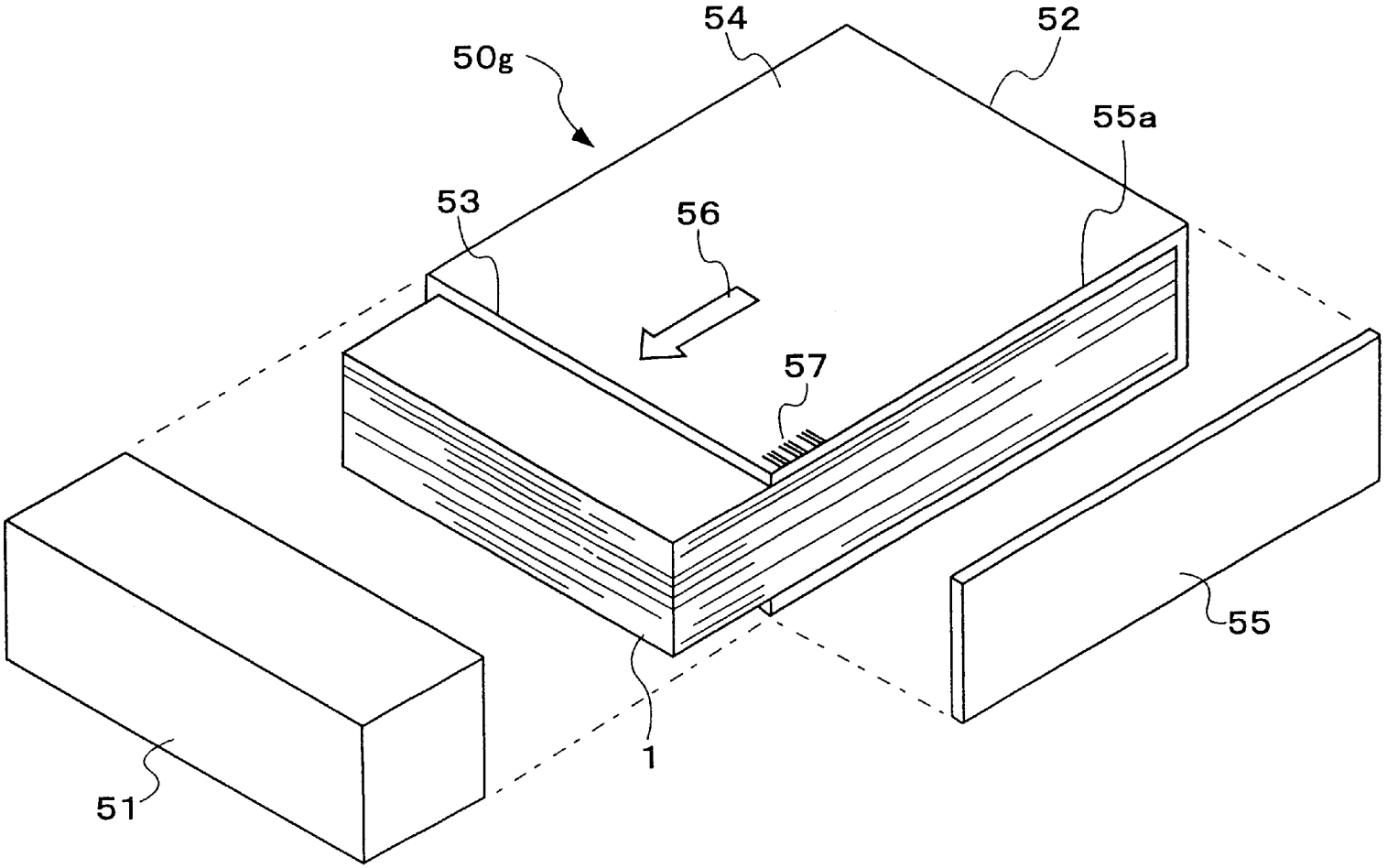
FIG. 19 is a perspective view of a cut sheet packaging member of the seventh embodiment according to the present invention.

Subsequently, the seventh embodiment of the cut sheet packaging member is explained in conjunction with FIG. 19.

A cut sheet packaging member 50*g* of this embodiment is characterized in that among a plurality of faces which constitute a body part 52, a side face 55 is made separable, which is disposed next to a face 54 on which a cut sheet insertion arrow 56 and cut sheet information are printed and is disposed at the left side as seen in the direction indicated by the cut sheet insertion arrow 56. On a border between this side face 55 and the body part 52, perforations are formed as a separation line 55*a* so as to ease the separation of the side face 55.

The reason why the side face 55 is made separable in this embodiment is to bring the side surface of a plurality of cut sheets 1 in the inside of the body part 52 into close contact with a fixed guide 45 of the printer 30. It is not always necessary to bring the side surface of a plurality of cut sheets 1 into close contact with the fixed guide 45. However, when a member which constitutes a side face of a cut sheet packaging member is relatively thick, it is preferable to bring the side face of a plurality of cut sheets 1 into close contact with the fixed guide 45 by separating this side face as in the case of this embodiment.

Figure 20:
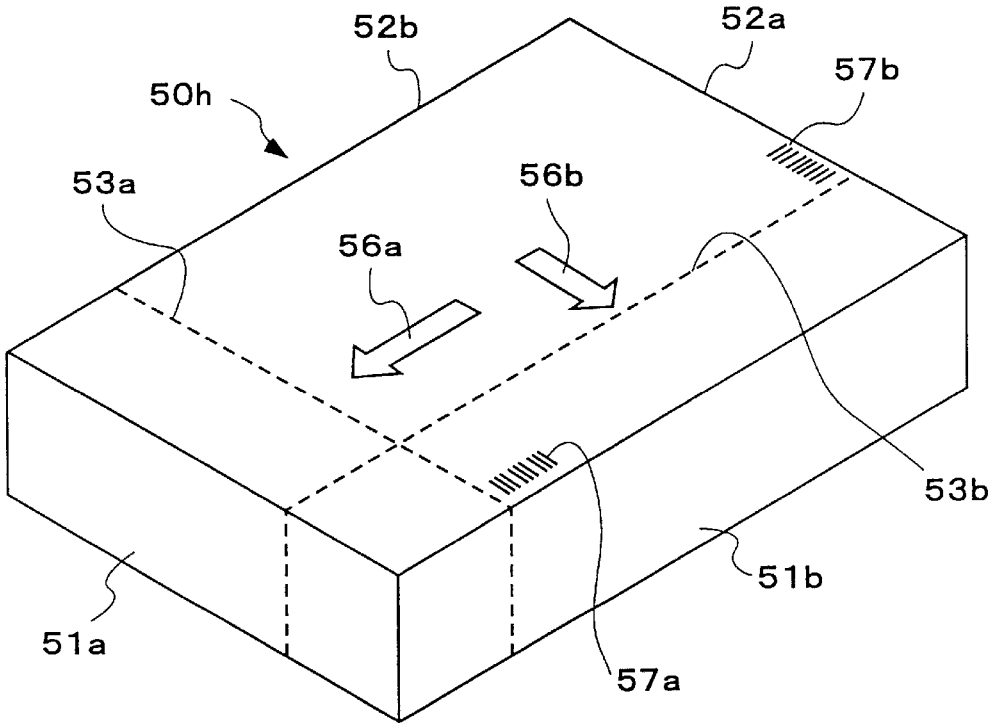
FIG. 20 is a perspective view of a cut sheet packaging member of the eighth embodiment according to the present invention.

Subsequently, the eighth embodiment of the cut sheet packaging member is explained in conjunction with FIG. 20.

The cut sheet packaging member 50*h* of this embodiment is a modification of the cut sheet packaging member 50*b* of the third embodiment explained in conjunction with FIG. 10 and is formed of cardboard (other thick sheet, hard paper or the like). This cut sheet packaging member 50*h* substantially has the same constitution as that of the cut sheet packaging member 50*b* of the third embodiment with the exception that the cut sheet packaging member 50*h* is not provided with stopper lugs 58*a,* 58*b* of the cut sheet packaging member 50*b* of the third embodiment. However, since the cut sheet packaging member 50*h* is formed of cardboard in this embodiment, separation lines 53*a,* 53*b* are made of perforations.

Since this embodiment has substantially the same constitution as that of the third embodiment with the exception that this embodiment has no stopper lug, this embodiment can enjoy the same advantageous effects as those of the third embodiment except for advantageous effects brought about by the stopper lug.

Figure 21:
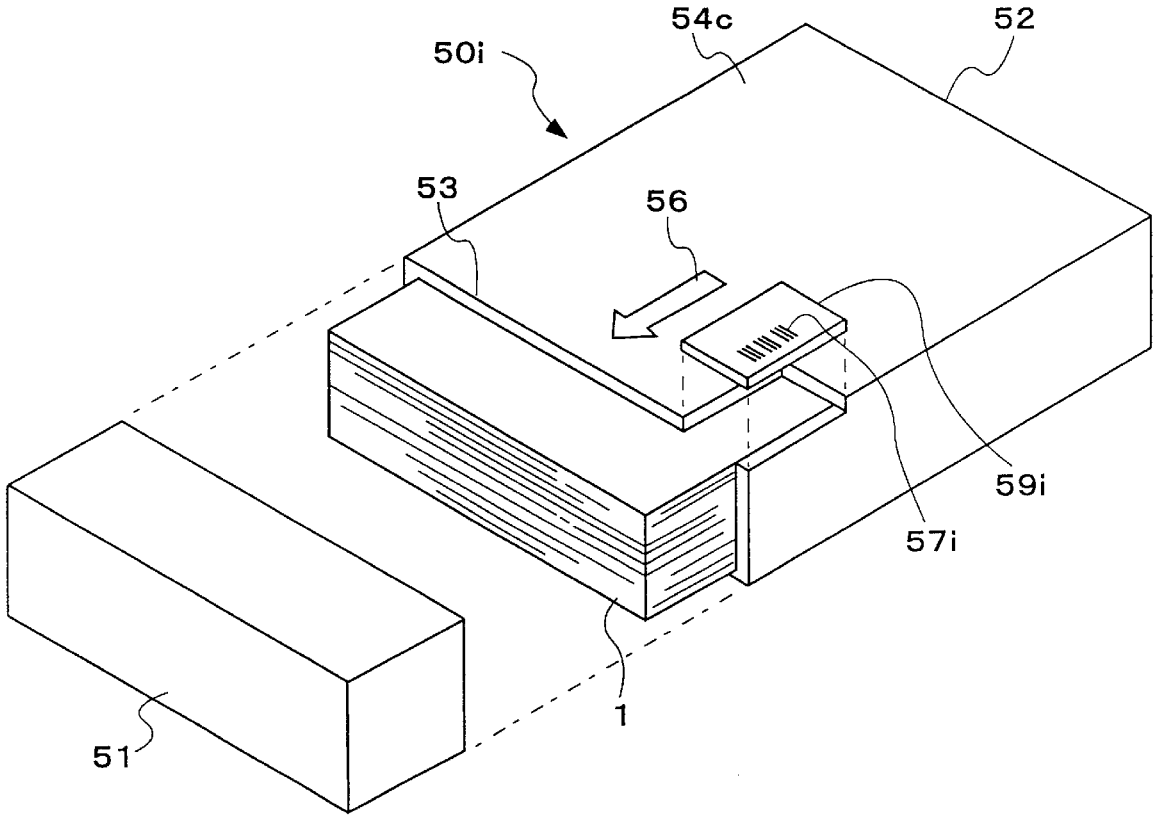
FIG. 21 is a perspective view of a cut sheet packaging member of the ninth embodiment according to the present invention.

Subsequently, the ninth embodiment of the cut sheet packaging member is explained in conjunction with FIG. 21.

Figure 12:
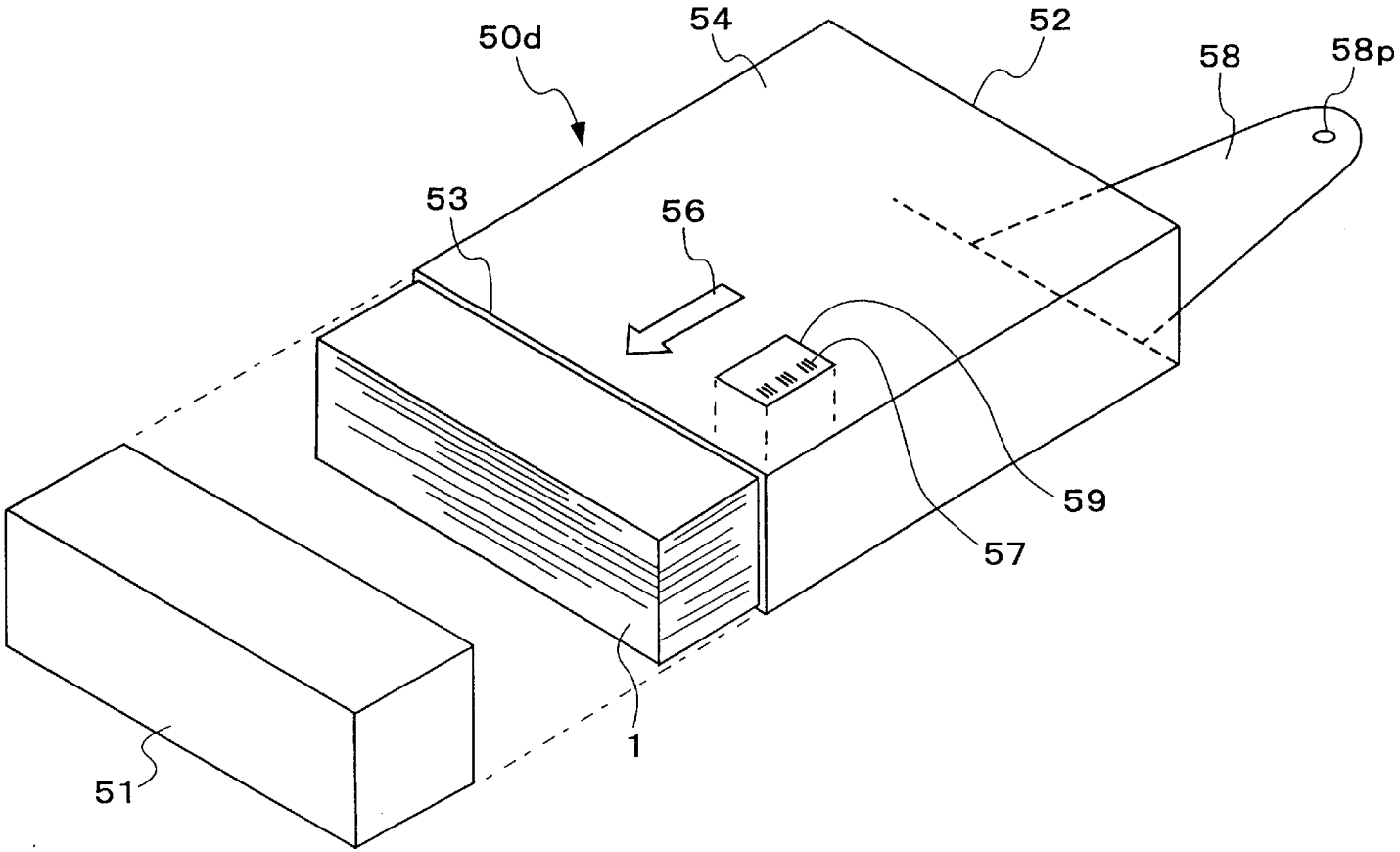
FIG. 12 is a perspective view of a cut sheet packaging member of the fourth embodiment according to the present invention.

The cut sheet packaging member 50*i* of this embodiment is a modification of the cut sheet packaging member 50*d* of the fourth embodiment explained in conjunction with FIG. 12 and is formed of cardboard (other thick sheet, hard paper or the like). This cut sheet packaging member 50*i* substantially has the same constitution as that of the cut sheet packaging member 50*d* of the third embodiment with the exception that the cut sheet packaging member 50*i* is not provided with stopper lug 58 of the cut sheet packaging member 50*d* of the third embodiment and that the cut sheet information 57*i* is printed on a part of a body part 52 as cut sheet information and then this portion is torn-off and used as an information card 59*i*. However, since the cut sheet packaging member 50*i* is formed of cardboard in this embodiment, a separation line 53 and a separation line disposed around a portion which becomes an information card 59*i* are made of perforations.

Since this embodiment also has substantially the same constitution as that of the fourth embodiment with the exception that this embodiment has no stopper lug and the information card 59*i* is not peeled off from the body part 52 but is separated from the body part 52, this embodiment can enjoy the same advantageous effects as those of the fourth embodiment except for the advantageous effect derived from such differences.

Figure 22:
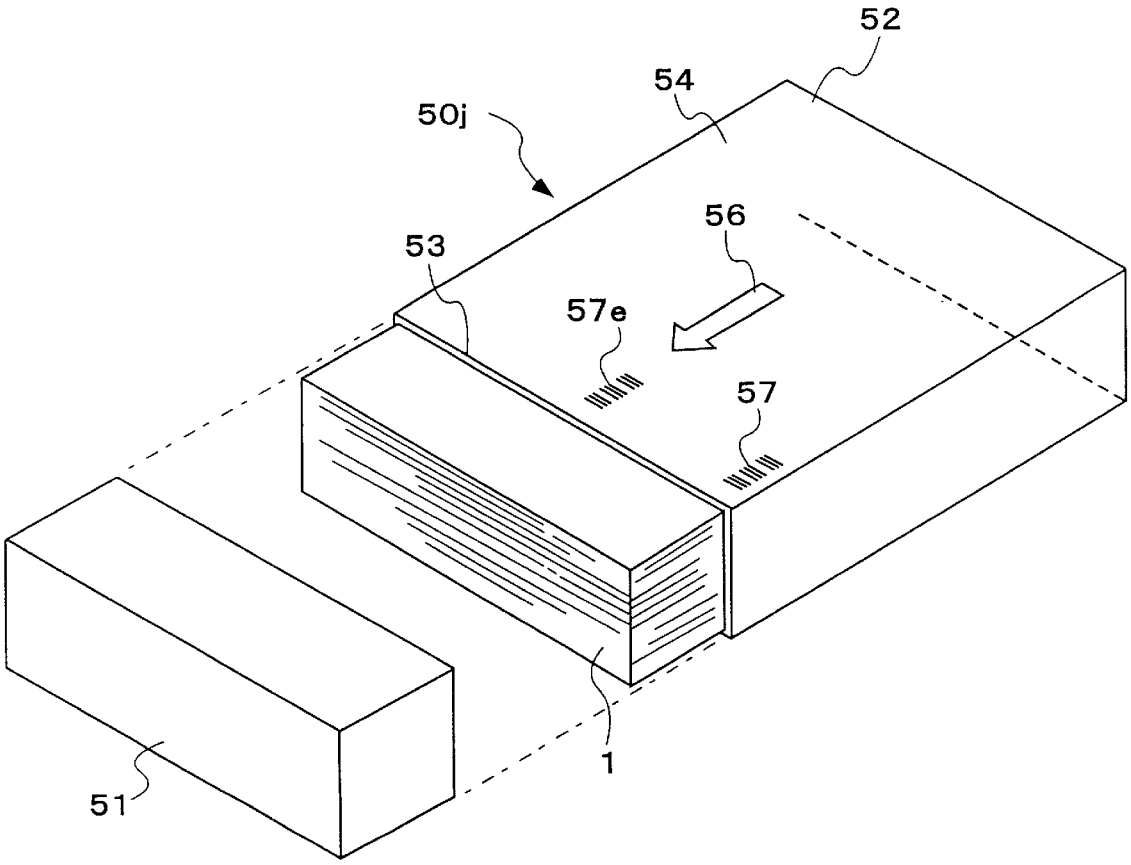
FIG. 22 is a perspective view of a cut sheet packaging member of the tenth embodiment according to the present invention.

Subsequently, the tenth embodiment of the cut sheet packaging member is explained in conjunction with FIG. 22.

The cut sheet packaging member 50*j* of this embodiment is a modification of the cut sheet packaging member 50 of the first embodiment explained in conjunction with FIG. 4 and is formed of cardboard (other thick sheet, hard paper or the like). This cut sheet packaging member 50*j* substantially has the same constitution as that of the cut sheet packaging member 50 of the first embodiment with the exception that the cut sheet packaging member 50*j* is not provided with stopper lug 58 of the cut sheet packaging member 50 of the first embodiment. However, since the cut sheet packaging member 50*j* is formed of cardboard in this embodiment, a separation line 53 is made of perforations to ease the dividing of the cut sheet packaging member 50*j* into a lid part 51 and a body part 52.

Since this embodiment also has substantially the same constitution as that of the first embodiment with the exception that it is provided with no stopper lug, this embodiment can enjoy the same advantageous effects as those of the first embodiment except for the advantageous effect derived from the stopper lugs.

Figure 23:
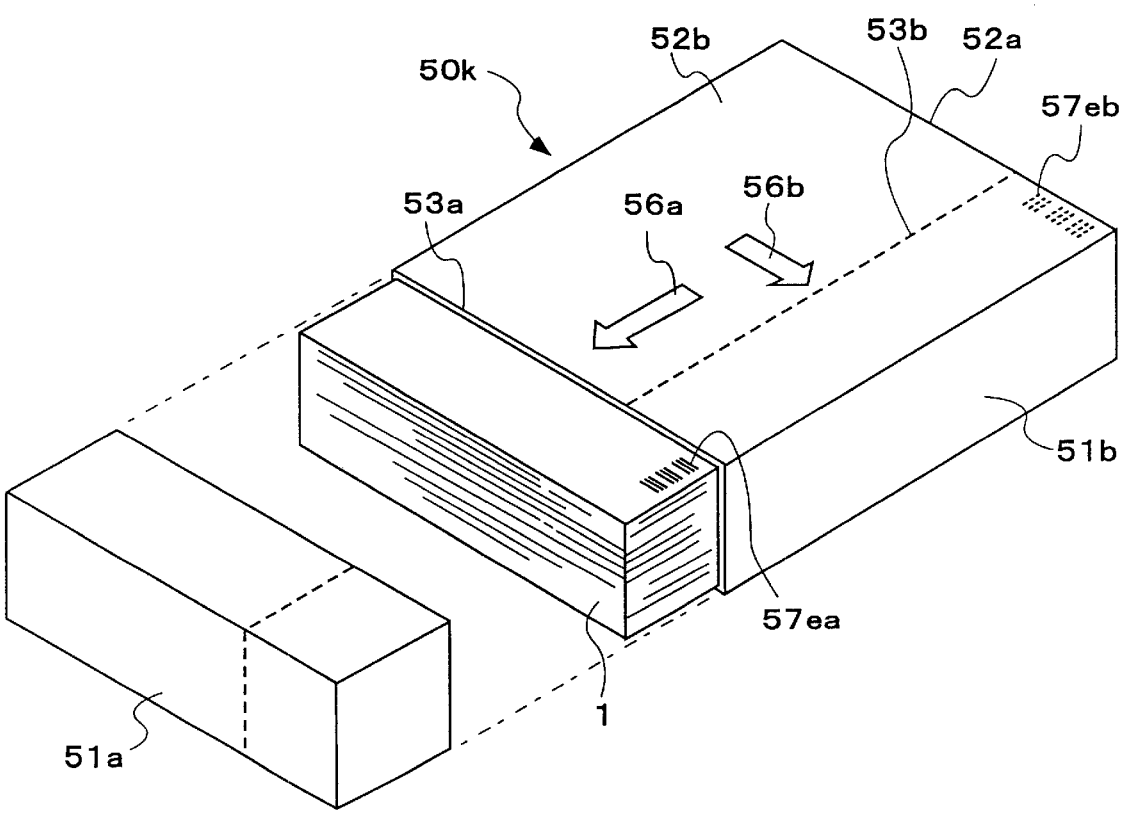
FIG. 23 is a perspective view of a cut sheet packaging member and cut sheets which are packaged in the cut sheet packaging member of the eleventh embodiment according to the present invention.

Subsequently, the eleventh embodiment of the cut sheet packaging member and cut sheets packaged by this cut sheet packaging member is explained in conjunction with FIG. 23.

In the same manner as the third embodiment, in a cut sheet packaging member 50*k* of this embodiment, a first separation line 53*a* is formed parallel to the lateral direction of the cut sheets such that a first lid part 51*a* is present at a position corresponding to a longitudinal end portion of the rectangular cut sheets 1 and a first body part 52*a* is present at a side corresponding to an opposite longitudinal end of the cut sheets 1. Further, a second separation line 53*b* is formed parallel to the longitudinal direction of the cut sheets 1 such that a second lid part 51*b* is present at a position corresponding to a lateral end portion of the cut sheets 1 and a second body part 52*b* is present at a side corresponding to an opposite lateral end of the cut sheets 1. As in the case of the third embodiment, a first cut sheet insertion arrow 56*a* is printed on the first body part 52*a* and a second cut sheet insertion arrow 56*b* is printed on the second body part 52*b*.

Among a plurality of cut sheets 1 which are packaged by this cut sheet packaging member 50*k,* on the cut sheet 1 which is positioned at an end in the stacking direction of the cut sheets 1, that is, on the uppermost cut sheet 1, cut sheet information 57*ea,* 57*eb* are printed. As the cut sheet information, the first cut sheet information 57*ea* is printed on a portion of the uppermost cut sheet 1 which is exposed when the first lid part 51*a* is separated, at a position disposed on the left side as seen in the direction indicated by the first cut sheet insertion arrow 56*a,* while the second cut sheet information 57*eb* is printed on a portion of the uppermost cut sheet 1 which is exposed when the second lid part 51*b* is separated, at a position disposed at the left side as seen in the direction indicated by the second cut sheet insertion arrow 56*b*.

In this embodiment, when the cut sheets 1 are used in portrait orientation, the first lid part 51*a* is separated from the first body part 52*a* and the cut sheets 1 are placed on the sheet feed tray such that the first cut sheet insertion arrow 56*a* is directed toward the sheet feed opening of a printer. In this step, the first cut sheet information 57*ea* printed on the uppermost cut sheet 1 is read by a bar code reader of the printer. Further, when the cut sheets 1 are used in landscape orientation, the second lid part 51*b* is separated from the second body part 52*b* and the cut sheets 1 are placed on the sheet feed tray such that the second cut sheet insertion arrow 56*b* is directed toward the sheet feed opening of the printer. In this step, the second cut sheet information 57*eb* printed on the uppermost cut sheet 1 is read by a bar code reader of the printer.

In this embodiment, since the cut sheet information 57*ea,* 57*eb* have been already printed on the uppermost cut sheet 1, it is necessary to discharge the uppermost cut sheet 1 before starting printing by the printer. Accordingly, information that the first cut sheet is directly discharged without printing may be added as a part of the cut sheet information.

Further, with respect to the cut sheet packaging member of this embodiment, the stopper lug may be provided therewith as in the case of the above-mentioned first to fifth embodiments. Further, in this embodiment, although the cut sheet information is affixed only to the uppermost cut sheet, it may be possible to affix the cut sheet information to the bottommost cut sheet. This provision is advantageous when the cut sheet insertion arrow is not printed on the cut sheet packaging member and the up-side-down of the cut sheet packaging member is indefinite. Further, although the cut sheet information may be affixed to the cut sheet at the fixed guide side of the printer in this embodiment, as in the case of the fifth embodiment, the cut sheet information may be also affixed to the central portion of each side of the cut sheet. Further, when the cut sheet information is affixed to the cut sheet as in the case of this embodiment, since the cut sheet is discharged from the discharge opening, the bar code reader may be installed at any portion as far as the portion is disposed between the sheet feed opening and the sheet discharge opening. Further, the bar code reader may be mounted on a printing head, for example. In this case, it is unnecessary to affix the cut sheet information to a portion which is exposed when the lid part is separated. Further, since the printer head is capable of moving in the direction perpendicular to the sheet feeding and discharging direction, the bar code may be arranged in the moving direction of the printing head.

Although all of the above-mentioned embodiments have been explained using the printer which functions as the image forming apparatus, the present invention is not limited thereto but applied to a copier.

What is claimed is:

1. A cut sheet packaging member accommodating a stack of rectangle cut sheets used for forming an image in an image forming apparatus, wherein a separation line for dividing the cut sheet packaging member into a lid part and a body part is formed in the lengthwise direction of said rectangle cut sheet accommodated by the cut sheet packaging member, and cut sheet information readable by a sensor is affixed to the body part at a position close to the separation line.

2. A cut sheet packaging member according to claim 1, wherein within a face which faces the cut sheets in an opposed manner, the cut sheet information is affixed at the center position of the body part in a direction perpendicular to the cut sheet insertion direction directed from the body part to the lid part.

3. A cut sheet packaging member according to claim 1, wherein the cut sheet information are affixed in parallel to the cut sheet insertion direction directed from the body part to the lid part.

4. A cut sheet packaging member according to claim 1, wherein the cut sheet information includes at least one of model number, size, kind of sheet, thickness, number of sheets, and unit price of the cut sheets.

5. A cut sheet packaging member according to claim 1, wherein the cut sheet information is indicated by a bar code.

6. A cut sheet packaging member according to claim 1, wherein the cut sheet information is indicated by a character as well as by a bar code.

7. A cut sheet packaging body comprising:

the cut sheet packaging member claimed in claim 1, and a plurality of cut sheets accommodated in the cut sheet packaging member.

8. A cut sheet packaging member comprising a stack of rectangular cut sheets used for forming images in an image forming apparatus, wherein a first separation line for dividing the cut sheet packaging member is formed such that a portion of the cut sheet packaging member corresponding to one longitudinal end side of the rectangular cut sheets accommodated therein constitutes a body part and a portion of the cut sheet packaging member corresponding to the other longitudinal end side of the rectangular cut sheets accommodated therein constitutes a lid part, a second separation line for dividing the cut sheet packaging member is formed such that a portion of the cut sheet packaging member corresponding to one lateral end side of the rectangular cut sheets accommodated therein constitutes a body part and a portion of the cut sheet packaging member corresponding to the other lateral end side of the rectangular cut sheets accommodated therein constitutes a lid part, and cut sheet information readable by sensors are respectively affixed to the body part when divided by the first separation line and the body part when divided by the second separation line.

9. A cut sheet packaging member accommodating a plurality of rectangular cut sheets used for forming images in an image forming apparatus in a stacked state, wherein a first separation line for dividing the cut sheet packaging member is formed such that a portion of the cut sheet packaging member corresponding to one longitudinal end side of the rectangular cut sheets accommodated therein constitutes a body part and a portion of the cut sheet packaging member corresponding to the other longitudinal end side of the rectangular cut sheets accommodated therein constitutes a lid part, a second separation line for dividing the cut sheet packaging member is formed such that a portion of the cut sheet packaging member corresponding to one lateral end side of the rectangular cut sheets accommodated therein constitutes a body part and a portion of the cut sheet packaging member corresponding to the other lateral end side of the rectangular cut sheets accommodated therein constitutes a lid part, portions to be latched which are engaged with a portion of a sheet feeding part of the image forming apparatus are respectively formed on the body part when divided by the first separation line and on a portion of the body part when divided by the second separation line such that the body part is not fed to the image forming apparatus together with the cut sheets, and cut sheet informations readable by a sensor are respectively affixed to the body part when divided by the first separation line and the body part when divided by the second separation line.

10. A cut sheet packaging member accommodating a stack of cut sheets used for forming an image in an image forming apparatus, wherein a separation line for dividing the cut sheet packaging member into a lid part and a body part is formed, cut sheet information readable by a sensor is affixed to the body part at a position close to the separation line, and when the lid part is removed and a side which has been covered with the lid part is directed toward the image forming apparatus and a plurality of cut sheets which are covered by the body part are disposed in the image forming apparatus, among a fixed guide and a movable guide which guide the widthwise position of the cut sheets in the image forming apparatus, the cut sheet information is affixed to the body part close the fixed guide side.

11. A cut sheet packaging member according to claim 10, wherein among a plurality of faces which constitutes the body part, the cut sheet information is affixed to one surface which faces surfaces of a plurality of packaged cut sheets, and when the lid part is removed and a side which has been covered with the lid part is directed toward the image forming apparatus and a plurality of cut sheets which are covered by the body part are disposed in the image forming apparatus, a face of the body part which faces the fixed guide in an opposed manner is removably formed.

12. A cut sheet packaging member accommodating a stack of cut sheets used for forming an image in an image forming apparatus, wherein a separation line for dividing the cut sheet packaging member into a lid part and a body part is formed, cut sheet information readable by a sensor is affixed to the body part at a position close to the separation line, and an arrow showing the cut sheet insertion direction directed from the body part to the lid part is affixed to the body part.

13. A cut sheet packaging member accommodating a plurality of cut sheets on which images are formed by an image forming apparatus, wherein the cut sheet packaging member includes an information card portion on which cut sheet information readable by the sensor is provided and the information card portion is removably mounted.

14. A cut sheet packaging member accommodating a stack of rectangular cut sheets used for forming images in an image forming apparatus, wherein a first separation line for dividing the cut sheet packaging member is formed such that a portion of the cut sheet packaging member corresponding to one longitudinal end side of the rectangular cut sheets accommodated therein constitutes a body part and a portion of the cut sheet packaging member corresponding to the other longitudinal end side of the rectangular cut sheets accommodated therein constitutes a lid part, a second separation line for dividing the cut sheet packaging member is formed such that a portion of the cut sheet packaging member corresponding to one lateral end side of the rectangular cut sheets accommodated therein constitutes a body part and a portion of the cut sheet packaging member corresponding to the other lateral end side of the rectangular cut sheets accommodated therein constitutes a lid part, and portions to be latched which are engaged with a portion of a sheet feeding part of the image forming apparatus are respectively formed on the body part when divided by the first separation line and on the body part when divided by the second separation line such that the body part is not fed to the image forming apparatus together with the cut sheets.

15. A cut sheet packaging body including a plurality of rectangular cut sheets on which images are formed by an image forming apparatus and a cut sheet packaging member which accommodates a plurality of cut sheets, wherein a first separation line for dividing the cut sheet packaging member is formed such that a portion of the cut sheet packaging member corresponding to one longitudinal end side of the rectangular cut sheets accommodated therein constitutes a body part and a portion of the cut sheet packaging member corresponding to the other longitudinal end side of the rectangular cut sheets accommodated therein constitutes a lid part, a second separation line for dividing the cut sheet packaging member is formed such that a portion of the cut sheet packaging member corresponding to one lateral end side of the rectangular cut sheets accommodated therein constitutes a body part and a portion of the cut sheet packaging member corresponding to the other lateral end side of the rectangular cut sheets accommodated therein constitutes a lid part, and among a plurality of cut sheets stacked in the inside of the cut sheet packaging member, cut sheet information readable by a sensor is affixed to the cut sheet positioned at an end in the stacking direction.

16. An image forming apparatus for forming an image on a surface of a cut sheet comprising:

reading means which reads cut sheet information affixed to a portion of a cut sheet packaging member for accommodating a plurality of such cut sheets, and output means which outputs at least a portion of the cut sheet information read by the reading means wherein a fixed guide and a movable guide which guide the position in the widthwise direction of the cut sheets are provided to a sheet feed opening for the cut sheet, and the reading means is provided at the fixed guide side in the inside of the sheet feed opening.

17. An image forming apparatus for forming an image on a surface of a cut sheet which is accommodated in a cut sheet packaging member dividable into a lid part and a body part comprising:

reading means which reads cut sheet information affixed to a portion of a cut sheet packaging member, output means which outputs at least a portion of the cut sheet information read by the reading means, a sheet feeding part in which a plurality of cut sheets are set, and a latch portion which, when the lid part is separated from the body part of the cut sheet packaging member and the body part is set in the sheet feed portion together with a plurality of cut sheets, engages the body part with the sheet feeding part to prevent the body part from be fed wherein a fixed guide and a movable guide which guide the position in the widthwise direction of the cut sheets are provided to a sheet feed opening for the cut sheet, and the reading means is provided at the fixed guide side in the inside of the sheet feed opening.

18. An image forming apparatus for forming an image on a surface of a cut sheet comprising:

reading means which reads cut sheet information affixed to a portion of a cut sheet packaging member for accommodating a plurality of such cut sheets, and output means which outputs at least a portion of the cut sheet information read by the reading means wherein a pair of movable guides for guiding the widthwise position of the cut sheets are provided to a sheet feed opening for the cut sheets, a pair of such movable guides are constituted such that when one movable guide approaches the other movable guide, the other movable guide also approaches one movable guide by the same distance and when one movable guide moves away from the other movable guide, the other movable guide also moves away from one movable guide by the same distance, and the reading means is provided in the sheet feed opening at a center position between a pair of such movable guides.

19. An image forming apparatus for forming an image on a surface of a cut sheet which is accommodated in a cut sheet packaging member dividable into a lid part and a body part comprising:

reading means which reads cut sheet information affixed to a portion of a cut sheet packaging member, output means which outputs at least a portion of the cut sheet information read by the reading means, a sheet feeding part in which a plurality of cut sheets are set, and a latch portion which, when the lid part is separated from the body part of the cut sheet packaging member and the body part is set in the sheet feed portion together with a plurality of cut sheets, engages the body part with the sheet feeding part to prevent the body part from be fed wherein a pair of movable guides for guiding the widthwise position of the cut sheets are provided to a sheet feed opening for the cut sheets, a pair of such movable guides are constituted such that when one movable guide approaches the other movable guide, the other movable guide also approaches one movable guide by the same distance and when one movable guide moves away from the other movable guide and the other movable guide also moves away from one movable guide by the same distance, and the reading means is provided in the sheet feed opening at a center position between a pair of such movable guides.

20. An image forming apparatus for forming an image on a surface of a cut sheet comprising:

reading means which reads cut sheet information affixed to a portion of a cut sheet packaging member for accommodating a plurality of such cut sheets, output means which outputs at least a portion of the cut sheet information read by the reading means, an information card mounting part allowing a portion having the cut sheet information affixed thereto to be inserted, the portion having been removed from the cut sheet packaging member, and the reading means being provided to the information card mounting part.

21. An image forming apparatus for forming an image on a surface of a cut sheet which is accommodated in a cut sheet packaging member dividable into a lid part and a body part comprising:.

reading means which reads cut sheet information affixed to a portion of a cut sheet packaging member, output means which outputs at least a portion of the cut sheet information read by the reading means, a sheet feeding part in which a plurality of cut sheets are set, and a latch portion which, when the lid part is separated from the body part of the cut sheet packaging member and the body part is set in the sheet feed portion together with a plurality of cut sheets, engages the body part with the sheet feeding part to prevent the body part from be fed an information card mounting part allowing a portion having the cut sheet information affixed thereto to be inserted, the portion having been removed from the cut sheet packaging member, and the reading means being provided to the information card mounting part.

22. An image forming apparatus for forming an image on a surface of a cut sheet comprising:

reading means which reads cut sheet information affixed to a portion of a cut sheet packaging member for accommodating a plurality of such cut sheets, output means which outputs at least a portion of the cut sheet information read by the reading means, wherein the output means has at least one of display means which displays at least a part of the cut sheet information read by the reading means and transmission means which transmits at least a part of the cut sheet information to an image forming control apparatus which controls the image forming apparatus.

23. An image forming apparatus for forming an image on a surface of a cut sheet which is accommodated in a cut sheet packaging member dividable into a lid part and a body part comprising:

reading means which reads cut sheet information affixed to a portion of a cut sheet packaging member, output means which outputs at least a portion of the cut sheet information read by the reading means, a sheet feeding part in which a plurality of cut sheets are set, and a latch portion which, when the lid part is separated from the body part of the cut sheet packaging member and the body part is set in the sheet feed portion together with a plurality of cut sheets, engages the body part with the sheet feeding part to prevent the body part from be fed wherein the output means has at least one of display means which displays at least a part of the cut sheet information read by the reading means and transmission means which transmits at least a part of the cut sheet information to an image forming control apparatus which controls the image forming apparatus.

24. A storage medium storing an operating program of an image forming control apparatus which includes a transmission/reception part which transmits an image forming command to an image forming apparatus for forming images on a surface of a cut sheet and a display part which displays various information, the operating program comprising;

a transmission/reception control step which allows the transmission/reception part to receive from the image forming apparatus cut sheet information including at least one of model number, kind of sheet, thickness of sheet and unit price of the cut sheets, and a display control step which allows the display part to display at least a part of the cut sheet information received by the transmission/reception part.

* * * * *